US011033116B2

(12) United States Patent
Long et al.

(10) Patent No.: US 11,033,116 B2
(45) Date of Patent: Jun. 15, 2021

(54) DUAL-SIDED VENTED POCKETED SPRING COMFORT LAYER

(71) Applicant: L&P Property Management Company, South Gate, CA (US)

(72) Inventors: Austin G. Long, Sarcoxie, MO (US); Shaw F. Robertson, Joplin, MO (US); Seth A. Thompson, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 11 days.

(21) Appl. No.: 16/548,958

(22) Filed: Aug. 23, 2019

(65) Prior Publication Data

US 2021/0052082 A1 Feb. 25, 2021

(51) Int. Cl.

| | |
|---|---|
| ***A47C 27/06*** | (2006.01) |
| ***A47C 7/34*** | (2006.01) |
| *A47C 27/04* | (2006.01) |

(52) U.S. Cl.

CPC ..... *A47C 27/064* (2013.01); *A47C 7/34* (2013.01); *A47C 27/04* (2013.01); *A47C 27/06* (2013.01); *A47C 27/065* (2013.01)

(58) Field of Classification Search

CPC ..... A47C 27/04; A47C 27/06; A47C 27/064; A47C 27/065; A47C 7/34; A47C 27/061

See application file for complete search history.

(56) References Cited

U.S. PATENT DOCUMENTS

| | | | | |
|---|---|---|---|---|
| 3,375,156 | A * | 3/1968 | Edgar, Jr. ..... | D04H 1/732 162/132 |
| 4,234,983 | A | 11/1980 | Stumpf | |
| 4,451,946 | A | 6/1984 | Stumpf | |
| 4,485,506 | A | 12/1984 | Stumpf et al. | |
| 4,573,741 | A | 3/1986 | Kirchner-Carl | |
| 4,574,099 | A | 3/1986 | Nixon | |
| 4,594,278 | A | 6/1986 | Nixon | |
| 5,105,488 | A | 4/1992 | Hutchinson et al. | |
| 5,438,718 | A | 8/1995 | Kelly et al. | |

(Continued)

FOREIGN PATENT DOCUMENTS

| | | |
|---|---|---|
| EP | 1067090 | 1/2001 |
| EP | 1707081 | 4/2008 |

(Continued)

OTHER PUBLICATIONS

U.S. Patent and Trademark Office; Search Report and Written Opinion in related International Patent Application No. PCT/US2020/043938 dated Oct. 13, 2020; 11 pages.

*Primary Examiner* — David R Hare
*Assistant Examiner* — Madison Emanski
(74) *Attorney, Agent, or Firm* — Wood Herron & Evans LLP

(57) ABSTRACT

A comfort layer for a bedding or seating product has fast-acting pockets characterized by the individual mini springs of the comfort layer being pocketed with permeable fabric having apertures therein. Apertures in the fabric facilitate airflow through the fabric. The permeable fabric is specifically structured to facilitate airflow while minimizing noise. Each seam joining opposed pieces of fabric around each of the mini coil springs of the comfort layer may be segmented, allowing air to flow between the segments.

20 Claims, 26 Drawing Sheets

(56) References Cited

U.S. PATENT DOCUMENTS

| | | | |
|---|---|---|---|
| 6,154,908 | A | 12/2000 | Wells |
| 6,319,864 | B1 | 11/2001 | Hannigan et al. |
| 6,447,874 | B2 | 9/2002 | Antinori et al. |
| 6,490,744 | B1 | 12/2002 | Schulz, Jr. |
| 6,537,930 | B1 | 3/2003 | Middlesworth et al. |
| 6,591,438 | B1 | 7/2003 | Edling |
| 6,598,251 | B2 | 7/2003 | Habboub et al. |
| 6,602,809 | B1 | 8/2003 | Cabrey |
| 6,706,225 | B2 | 3/2004 | Cabrey |
| 6,826,796 | B1 | 12/2004 | Mossbeck |
| 7,410,030 | B2 | 8/2008 | Fusiki et al. |
| 7,622,406 | B2 | 11/2009 | Holland et al. |
| 7,636,972 | B2 | 12/2009 | Mossbeck et al. |
| 7,788,952 | B2 | 9/2010 | Morrison |
| 7,820,570 | B2 | 10/2010 | Holland et al. |
| 7,828,029 | B2 | 11/2010 | Holland et al. |
| 7,877,964 | B2 | 2/2011 | Spinks et al. |
| 8,011,046 | B2 | 9/2011 | Stjerna |
| 8,087,114 | B2 | 1/2012 | Lundevall |
| 8,136,187 | B2 | 3/2012 | Mossbeck et al. |
| 8,157,051 | B2 | 4/2012 | Marcel et al. |
| 8,322,487 | B1 | 12/2012 | Kitchen et al. |
| 8,464,830 | B2 | 6/2013 | Ishikawa et al. |
| 8,474,078 | B2 | 7/2013 | Mossbeck |
| 8,574,700 | B2 | 11/2013 | Hattori |
| 8,695,757 | B2 | 4/2014 | Duval et al. |
| 9,133,615 | B2 | 9/2015 | Bischoff et al. |
| 10,405,665 | B2 | 9/2019 | Long |
| 2002/0025747 | A1 | 2/2002 | Rock et al. |
| 2003/0009831 | A1 | 1/2003 | Giori et al. |
| 2003/0104735 | A1 | 6/2003 | Rock et al. |
| 2004/0010853 | A1 | 1/2004 | Muci et al. |
| 2004/0133988 | A1 | 7/2004 | Barber |
| 2005/0273938 | A1 | 12/2005 | Metzger et al. |
| 2007/0044243 | A1 | 3/2007 | Metzger |
| 2007/0137926 | A1 | 6/2007 | Albin, Jr. et al. |
| 2007/0261548 | A1 | 11/2007 | Vrzalik et al. |
| 2007/0289069 | A1 | 12/2007 | Wells |
| 2009/0211028 | A1 | 8/2009 | Richmond et al. |
| 2009/0222985 | A1 | 9/2009 | Richmond et al. |
| 2009/0298374 | A1 | 12/2009 | Delmas |
| 2010/0212090 | A1 | 8/2010 | Stjerna |
| 2010/0255270 | A1 | 10/2010 | Stuebiger |
| 2011/0014406 | A1 | 1/2011 | Coleman et al. |
| 2011/0113551 | A1 | 5/2011 | Lin |
| 2011/0314613 | A1 | 12/2011 | Haffner et al. |
| 2012/0167303 | A1 | 7/2012 | Stroh et al. |
| 2013/0029550 | A1 | 1/2013 | Seth et al. |
| 2013/0174350 | A1 | 7/2013 | Allman et al. |
| 2013/0198941 | A1 | 8/2013 | John et al. |
| 2014/0287643 | A1 | 9/2014 | Nozaki et al. |
| 2014/0373282 | A1 | 12/2014 | Mossbeck et al. |
| 2015/0026893 | A1 | 1/2015 | Garrett et al. |
| 2015/0284901 | A1 | 10/2015 | Blackwell, Jr. et al. |
| 2015/0359349 | A1 | 12/2015 | Eigenmann et al. |
| 2015/0359350 | A1 | 12/2015 | Eigenmann et al. |
| 2016/0235212 | A1 | 8/2016 | Krtek et al. |
| 2017/0251820 | A1 | 9/2017 | Long |
| 2018/0344045 | A1 | 12/2018 | Jewett et al. |
| 2019/0269251 | A1* | 9/2019 | Eigenmann ..... A47C 7/35 |

FOREIGN PATENT DOCUMENTS

| | | |
|---|---|---|
| EP | 2789267 | 10/2014 |
| GB | 167025 | 2/1921 |
| KR | 200462261 | 9/2012 |
| WO | 2014023975 | 2/2014 |

* cited by examiner

DUAL-SIDED VENTED POCKETED SPRING COMFORT LAYER

TECHNICAL FIELD OF THE INVENTION

This invention relates to a comfort layer for use in bedding and seating products and the method of manufacturing such a comfort layer.

BACKGROUND OF THE INVENTION

Comfort layers are commonly used in seating or bedding products above/below a core, which commonly is a pocketed spring assembly core. Such comfort layers may include foam, fiber and gel products. Conventional comfort layers are made of individually pocketed mini coil springs joined together with two pieces of spunbonded polypropylene fabric which results in comfort cores, which may be less desirable than the comfort layers of the present invention for the reasons below.

U.S. Pat. Nos. 9,943,173 and 9,968,202, each fully incorporated by reference herein, disclose comfort layers made with fabric material which is semi-impermeable to airflow through the fabric material. In such comfort layers, the fabric retards, but does not stop, airflow through the fabric, thereby giving the comfort layer a unique slow to compress, slow to recover feel.

Other comfort layers disclosed in U.S. Pat. Nos. 9,943,173 and 9,968,20 are made with layered fabric impermeable to airflow through the fabric. In such comfort layers, air flows between pockets only through gaps between seam segments, thereby giving the comfort layer a different slow to compress, slow to recover feel.

However, in all the comfort layers disclosed in U.S. Pat. Nos. 9,943,173 and 9,968,20, air does not freely flow through the fabric. Therefore, a bedding or seating product incorporating one or more of these comfort layers may have a warmer feel than desired due to the impedance of airflow through the comfort layer(s).

European Patent No. EP 1707081 discloses a pocketed spring mattress in which each pocket has a ventilation hole in order to improve the airflow into and out of the pocket. However, one drawback to such a product, depending upon the fabric used in the product, is that the fabric of the pocket may create "noise", as the sound is named in the industry. Such noise may be created by the fabric expanding upon removal of the load due to the coil spring's upwardly directed force on the fabric.

It is therefore an objective of this invention to provide a pocketed spring comfort layer for a seating or bedding product, which has increased airflow through the comfort layer for cooling purposes.

Still another objective of this invention is to provide a pocketed spring comfort layer for a seating or bedding product having less noise than known pocketed spring comfort layers.

SUMMARY OF THE INVENTION

The invention, which accomplishes these objectives, comprises a comfort layer configured to overlay a spring core of a seating or bedding product. The comfort layer comprises an assembly or matrix of individually pocketed mini coil springs, each spring being contained within a fabric pocket. The fabric pocketing material within which the mini springs are contained, spunlaced aperture nonwoven fabric has an array or pattern of apertures that allows airflow through the fabric at a greater rate than conventional spunbond nonwoven polypropylene fabric. Due to the fabric of the comfort layers of the present invention, a bedding or seating product, such as a mattress, may have a cooler feel in areas of body contact with the product due to increased airflow through the comfort layers of the product.

The vented spunlaced aperture nonwoven fabric is permeable to airflow through the fabric material. As used herein, the term "permeable" means that the fabric material permits airflow through the material at a rate which does not retard or slow the rate at which a spring maintained in a pocket of the fabric may compress under load or return to its original height when a load is removed from the pocketed spring. In other words, air may pass through such a permeable material at a higher or increased rate compared to the rate at which air usually flows through a nonwoven polypropylene fabric commonly used in the bedding industry.

Each pocket has a weld seam around the pocket joining first and second pieces of fabric. The weld seams may be circular or rectangular. At least one of the pieces of fabric is made of a nonwoven spunlaced aperture fabric to increase the rate at which air escapes though the fabric when a load is placed on the pocket. At least one of the pieces of fabric may be made at least partially of polyester. Additionally, the rate of compression of the coil springs subjected to the load is increased by apertures in the fabric. The apertures are preferably oval-shaped, but may be any desired shape. Similarly, the size of the apertures may be as desired.

When a load is applied to a comfort layer made with permeable fabric, the rate of deflection of the comfort layer is enhanced by the rate at which air escapes through the permeable fabric within which the pocketed springs are contained and by the rate at which air travels between segments of seams separating individual pockets. Much more air escapes the pockets through the fabric than between the seam segments.

Any of the embodiments of comfort layer shown or described herein may be incorporated into a bedding product, such as a mattress, foundation or pillow. Further, any of the embodiments of comfort layer shown or described herein may be incorporated into a seating product, such as a vehicle seat and/or office or residential furniture, such as a recliner. Alternatively, any of the embodiments of comfort layer shown or described herein may be sold independently as a retail or wholesale item. In such an application, the comfort layer may be added to and/or removed from a bedding or seating product by a customer.

The comfort layer of the present invention, whether incorporated inside a bedding or seating product, or manufactured and sold as a separate product, provides an additional cooling effect to the product due to airflow through the comfort layer, including between adjacent pockets. The amount of airflow between pockets may be changed by changing the size of the teeth or slots on a welding tool, including an ultrasonic welding tool. An alternative way to adjust airflow inside a comfort layer and out of the comfort layer is to change the fabric material of the comfort layer.

According to another aspect of the invention, a comfort layer is configured to overlay a spring core of a seating or bedding product. The comfort layer comprises an assembly or matrix of mini coil springs. The comfort layer further comprises a first piece of nonwoven spunlaced aperture fabric permeable to airflow through the fabric on one side of the matrix of mini coil springs. The comfort layer further comprises a second piece of nonwoven spunlaced aperture fabric on another side of the matrix of mini coil springs. The first and second pieces of fabric are permeable to airflow through the fabric. Due to apertures in the fabric, air may pass through such a permeable fabric material at a higher or increased rate compared to the rate at which air flows through a nonwoven polypropylene material commonly used in the bedding industry. The apertures are preferably oval-shaped, but may be any desired shape. Similarly, the size of the apertures may be as desired.

The first and second pieces of fabric are joined together with weld seams to create individual pockets which contain the mini coil springs. The weld seams may be circular or rectangular. The weld seams may be solid or segmented. Segmented weld seams have gaps between weld segments through which air may flow.

According to another aspect of the invention, a comfort layer is configured to overlay a spring core of a seating or bedding product. The comfort layer comprises mini coil springs and a first piece of nonwoven spunlaced aperture fabric permeable to airflow through the fabric on one side of the mini coil springs. The comfort layer further comprises a second piece of nonwoven spunlaced aperture fabric on another side of the mini coil springs. The first and second pieces of fabric are joined together with weld seams comprising spaced weld segments surrounding each of the mini coil springs to create gaps between weld segments and individual pockets which contain the mini coil springs. The first and second pieces of fabric are permeable to airflow through the fabric. The weld seams may be circular or rectangular.

When at least some of the pockets are subjected to a load, air moves out of the pockets through the apertures in the fabric and through the gaps between the segments of the seams, the rate of compression of the mini coil springs being increased by the size of the gaps between the weld segments of the weld seams and apertures in the fabric. The nonwoven spunlaced aperture fabric may be made of any fabric weldable to itself and is commonly made of at least some polyester fibers.

These and other objects and advantages of this invention will be more readily apparent from the following drawings, in which:

DETAILED DESCRIPTION OF THE DRAWINGS

Figure 1:
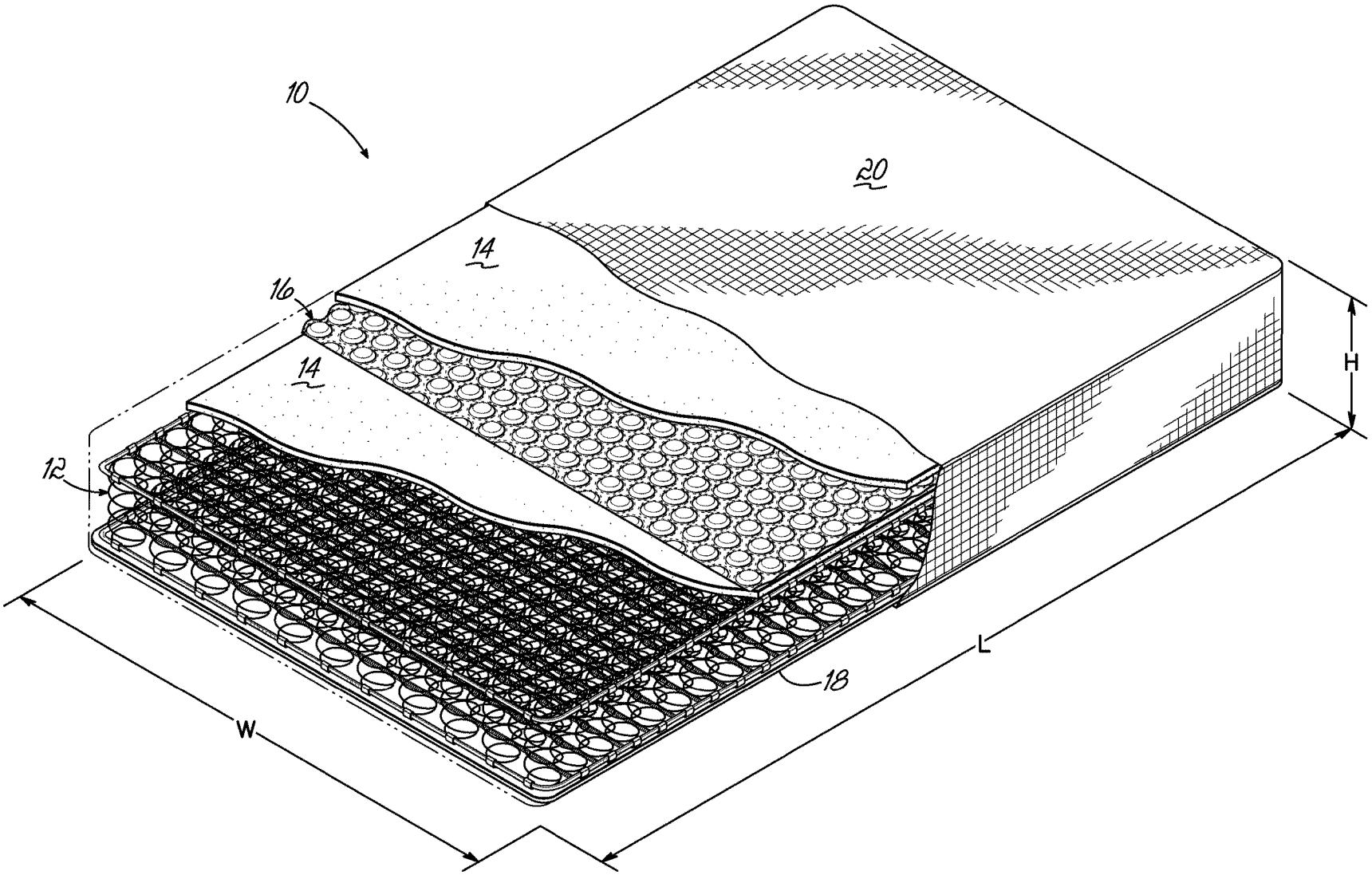
FIG. 1 is a perspective view, partially broken away, of a bedding product incorporating one of the comfort layers of this invention.

With reference to FIG. 1, there is illustrated a single-sided mattress 10 incorporating one embodiment of comfort layer in accordance with this invention. This mattress 10 comprises a spring core 12 over the top of which there is a conventional cushioning pad 14, which may be partially or entirely made of foam or fiber or gel, etc. The cushioning pad 14 may be covered by a comfort layer 16 constructed in accordance with the present invention. A second conventional cushioning pad 14 may be located above the comfort layer 16. In some applications, one or both of the cushioning pads 14 may be omitted. This complete assembly may be mounted upon a base 18 and is completely enclosed within an upholstered cover 20.

As shown in FIG. 1, mattress 10 has a longitudinal dimension or length L, a transverse dimension or width W and a height H. Although the length L is shown as being greater than the width W, they may be identical. The length, width and height may be any desired distance and are not intended to be limited by the drawings.

While several embodiments of comfort layer are illustrated and described as being embodied in a single-sided mattress, any of the comfort layers shown or described herein may be used in a single-sided mattress, double-sided mattress or seating cushion. In the event that any such comfort layer is utilized in connection with a double-sided product, then the bottom side of the product's core may have a comfort layer applied over the bottom side of the core and either comfort layer may be covered by one or more cushioning pads made of any conventional material. According to the practice of this invention, though, either the cushioning pad or pads, on top and/or bottom of the core, may be omitted. The novel features of the present invention reside in the comfort layer.

Although spring core 12 is illustrated being made of unpocketed coil springs held together with helical lacing wires, the core of any of the products, such as mattresses shown or described herein, may be made wholly or partially of pocketed coil springs (see FIG. 7), one or more foam pieces (not shown) or any combination thereof. Any of the comfort layers described or shown herein may be used in any single or double-sided bedding or seating product having any conventional core. This document is not intended to limit in any way the core. The core may be any conventional core including, but not limited to, pocketed or unpocketed spring cores.

Figure 4:
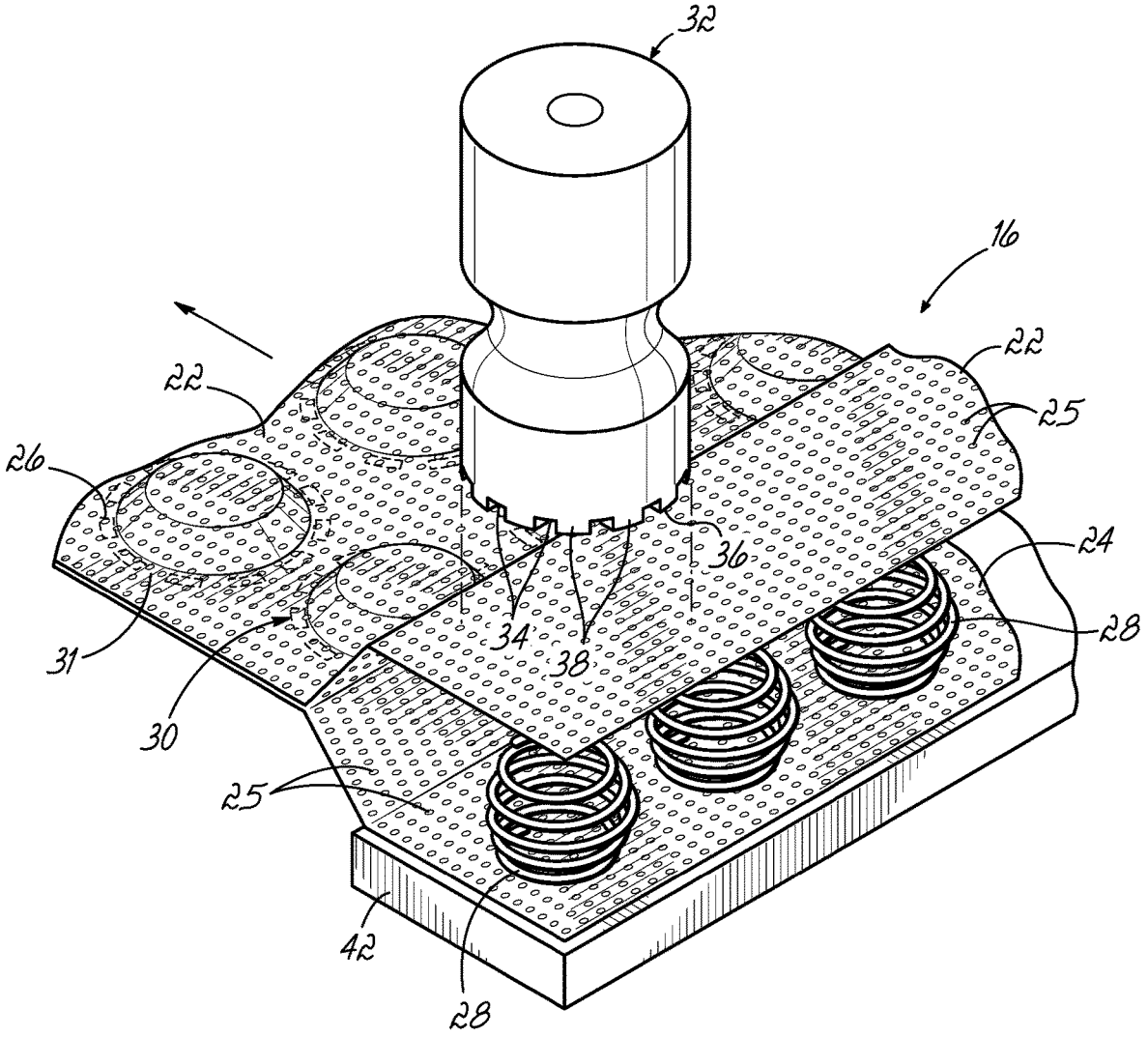
FIG. 4 is an enlarged perspective view of a portion of the comfort layer of FIG. 1 partially disassembled and showing a portion of a welding tool.

FIG. 4 illustrates the components of one embodiment of comfort layer 16 incorporated into the mattress 10 shown in FIG. 1. The comfort layer 16 comprises a first or upper piece of fabric 22 and a second or lower piece of fabric 24 with a plurality of mini coil springs 28 therebetween. Each of the first and second pieces of fabric 22, 24 is made of nonwoven spunlaced aperture fabric having a pattern of apertures 25 therethrough which allow air to flow quickly through the fabric. One of the apertures 25 is shown in detail in FIG. 18.

The fabric pieces 22, 24 are joined together with circular containments or weld seams 30, each weld seam 30 surrounding a mini coil spring 28. Each weld seam 30 comprises multiple arced or curved weld segments 26 with gaps 31 therebetween. The first and second pieces of fabric 22, 24 are joined together along each arced or curved weld segment 26 of each circular weld seam 30. The first and second pieces of fabric 22, 24 are not joined together along each gap 31 between adjacent weld segments 26 of each circular weld seam 30. The curved weld segments 26 are strategically placed around a mini coil spring 28 and create the circular weld seam 30. The two pieces of fabric 22, 24, in combination with one of the circular weld seams 30, define a cylindrical-shaped pocket 44, inside of which is at least one mini coil spring 28. See FIGS. 5 and 5A.

During the welding process, the mini coil springs 28 may be at least partially compressed before pocket 44 is closed and thereafter. If desired, resilient members other than mini coil springs, such as foam members, may be used. Alternatively, resilient members made of other resilient material(s), including those partially made of foam, which return to an original configuration after a load is removed from the material, may be used inside the pockets.

Figure 5:
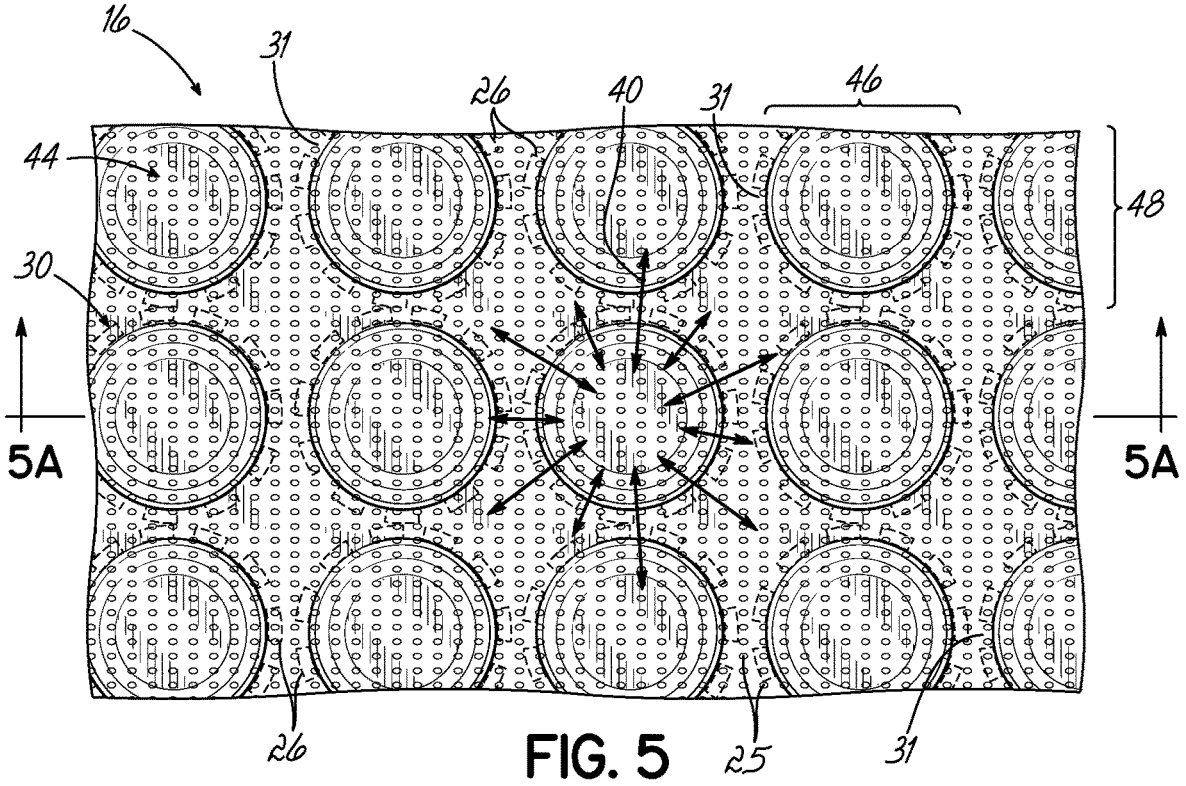
FIG. 5 is a top plan view of a portion of the comfort layer of FIG. 1, the arrows showing airflow inside the comfort layer.
Figure 5A:
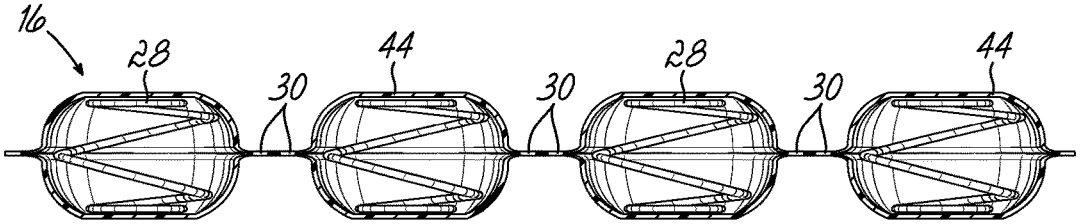
FIG. 5A is a cross-sectional view taken along the line 5A-5A of FIG. 5.
Figure 6:
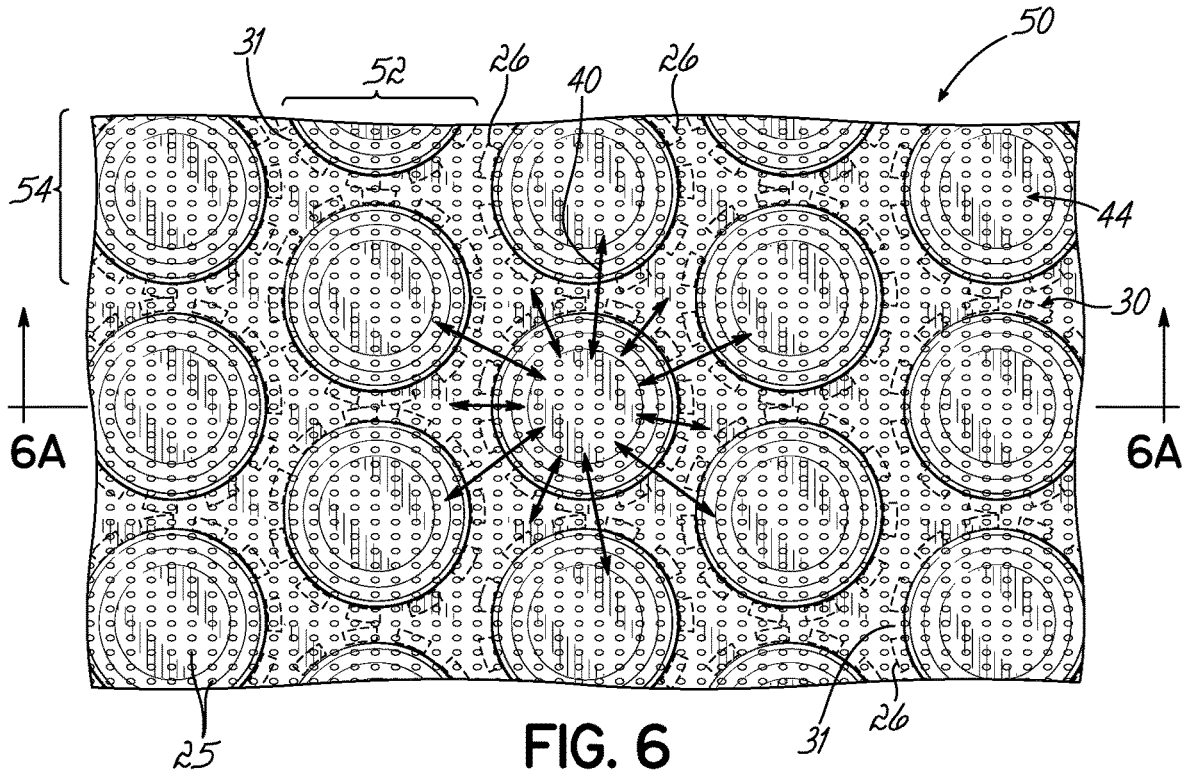
FIG. 6 is a top plan view of a portion of another comfort layer, the arrows showing airflow inside the comfort layer.
Figure 6A:
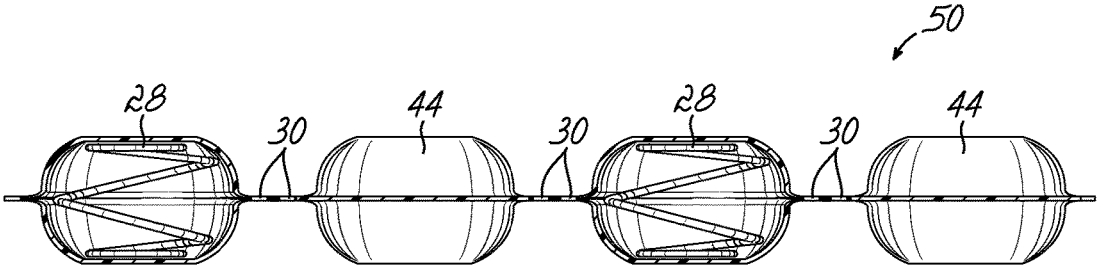
FIG. 6A is a cross-sectional view taken along the line 6A-6A of FIG. 6.

The size of the curved weld segments 26 of weld seams 30 are not intended to be limited by the illustrations; they may be any desired size depending upon the airflow desired inside the comfort layer. Similarly, the size, i.e., diameter of the illustrated weld seams 30, is not intended to be limiting. The placement of the weld seams 30 shown in the drawings is not intended to be limiting either. For example, the weld seams 30 may be organized into aligned rows and columns, as shown in FIGS. 5 and 5A or organized with adjacent columns being offset from each other, as illustrated in FIGS. 6 and 6A. Any desired arrangement of weld seams may be incorporated into any embodiment shown or described herein.

The weld segments may assume shapes other than the curved weld segments illustrated. For example, the welds or seams may be circular around mini coil springs, but the weld segments may assume other shapes, such as triangles or circles or ovals of the desired size and pattern to obtain the desired airflow between adjacent pockets inside the comfort layer and into or out of the perimeter of the comfort layer.

In any of the embodiments shown or described herein, each mini coil spring 28 in a relaxed condition may be between approximately 0.75 and 2.5 inches tall, have a diameter of approximately three inches and be made of seventeen and one-half gauge wire. While compressed inside one of the pockets 44, each of the mini coil springs 28 may be approximately one and one-half inches tall. However, the mini coil springs 28 in a relaxed condition may be any desired height, have any desired shape, such as an hourglass or barrel shape, and be made of any desired wire thickness or gauge.

The focus of the present invention is on the fabric which makes up at least one of the first and second pieces of fabric 22, 24. Although the drawings show the first and second pieces of fabric 22, 24 being identical, it is within the scope of the present invention that only one of the first and second pieces of fabric 22, 24 be the aperture fabric shown in the drawings.

Figure 18:
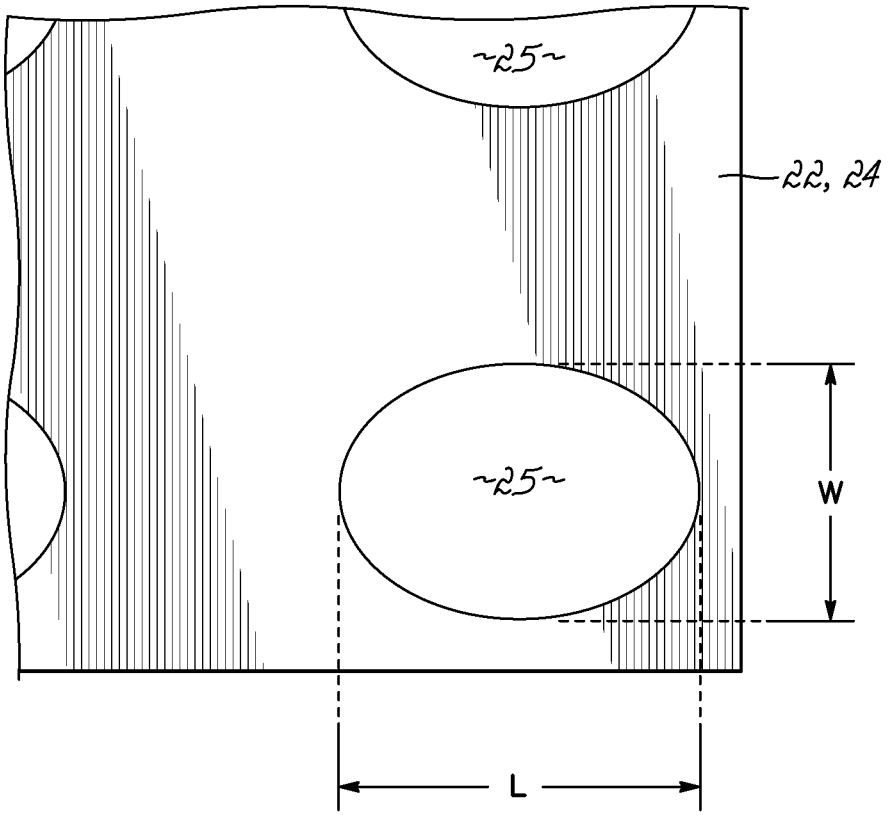
FIG. 18 is an enlarged view of one of the apertures of the nonwoven spunlaced aperture fabric used in the comfort layers of the present invention.

As best shown in FIG. 18, each of the apertures 25 shown throughout each of the first and second pieces of fabric 22, 24 has an oval-shape comprising a length "L" and a width "W" in a relaxed condition. Some fabrics which have proven satisfactory are available from Hangzhou Nbond Nonwoven Company, Limited of China. These fabrics include a nonwoven spunlaced aperture fabric having four apertures per square centimeter in which the length dimension "L" is three (3) millimeters and the width dimension "W" is 2.5 millimeters. This fabric is known in the industry as a four-mesh fabric.

Another fabric from the same supplier is a nonwoven spunlaced aperture fabric having eight apertures per square centimeter in which the length dimension "L" is three millimeters and the width dimension "W" is one millimeter. This fabric is known in the industry as an eight-mesh fabric.

Another fabric from the same supplier is a nonwoven spunlaced aperture fabric having ten apertures per square centimeter in which the length dimension "L" is 1.8 millimeters and the width dimension "W" is one millimeter. This fabric is known in the industry as a ten-mesh fabric.

Another fabric from the same supplier is a nonwoven spunlaced aperture fabric having twenty apertures per square centimeter in which the length dimension "L" is 1.2 millimeters and the width dimension "W" is 0.7 millimeter. This fabric is known in the industry as a twenty-mesh fabric.

Another fabric from the same supplier is a nonwoven spunlaced aperture fabric having twenty-two apertures per square centimeter in which the length dimension "L" is 0.8 millimeters and the width dimension "W" is 0.4 millimeter. This fabric is known in the industry as a twenty-two mesh fabric.

Each of the first and second pieces of fabric 22, 24 preferably has a fabric weight of between 45 grams per square meter and 150 grams per square meter, but may have any desired fabric weight. Any of these nonwoven spunlaced aperture fabrics is said to be vented and allows air to flow freely though the material while still providing enough surface area to glue one piece of the nonwoven spunlaced aperture fabric to another surface, such as a surface of a foam piece of a surface of a pocketed spring assembly.

In order to be weldable to itself, the nonwoven spunlaced aperture fabric must be made of at least 50 percent synthetic fibers, such as polyester fibers, including polyethylene terephthalate (PET) fibers. The other fibers in the fabric may be made of viscose fibers, bamboo, Tencel, cotton, nylon, bio-component fiber, polylactic acid ("PLA") fiber, rayon or wood pulp or any combination thereof.

With reference to FIG. 4, there is illustrated a portion of a mobile ultrasonic welding horn 32 and anvil 42. The movable ultrasonic welding horn 32 has a plurality of spaced cut-outs or slots 34 along its lower edge 36. The remaining portions 38 of the ultrasonic welding horn's bottom 36 between the slots 34 are the portions which weld the two pieces of fabric 22, 24 together and create the curved weld segments 26. Along the ultrasonic welding horn's bottom edge 36, the ultrasonic welding horn 32 can be milled to make the slots a desired length to allow a desired airflow between the curved weld segments 26 as illustrated by the arrows 40 of FIG. 5. The airflows affect the feel/compression of the individually pocketed mini coil springs 28 when a user lays on the mattress 10.

As shown in FIG. 4, underneath the second piece of fabric 24 is an anvil 42 comprising a steel plate of $3/8^{th}$ inch thickness. However, the anvil may be any desired thickness. During the manufacturing process, the ultrasonic welding horn 32 contacts the anvil 42, the two pieces of fabric 22, 24 therebetween, to create the circular weld seams 30 and, hence, cylindrical-shaped pockets 44, at least one mini coil spring being in each pocket 44.

These curved weld segments 26 are created by the welding horn 32 of a machine (not shown) having multiple spaced protrusions 38 on the ultrasonic welding horn 32. As a result of these circular weld seams 30 joining pieces 22, 24, the pieces 22, 24 define a plurality of spring-containing pockets 44 of the comfort layer 16. One or more mini coil springs 28 may be contained within an individual pocket 44.

Figure 4A:
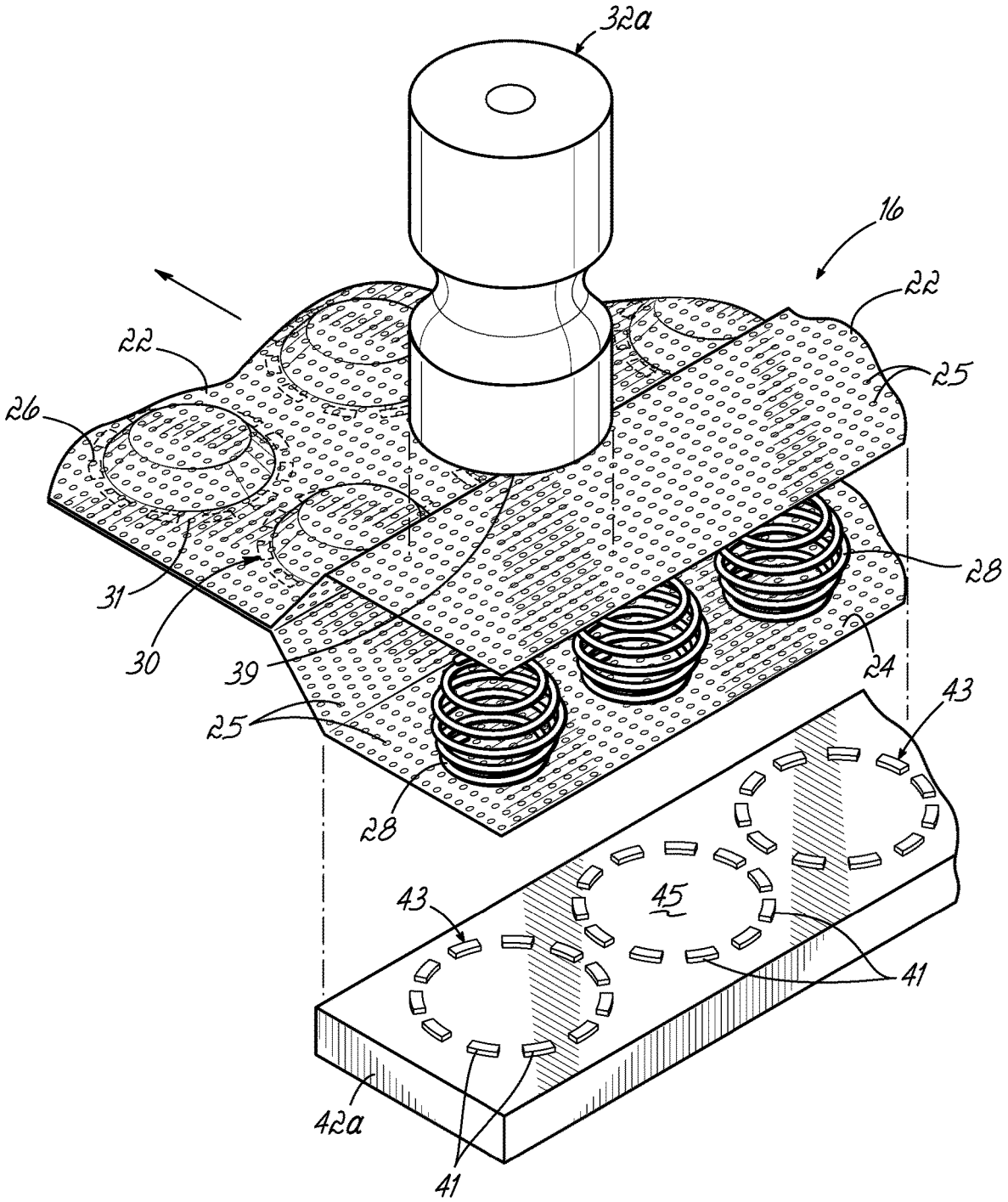
FIG. 4A is an enlarged perspective view of a portion of the comfort layer of FIG. 1 partially disassembled and showing a portion of another welding tool.

FIG. 4A illustrates another apparatus for forming the circular weld seams 30 comprising multiple curved weld segments 26 having gaps 31 therebetween for airflow. In this apparatus, the ultrasonic welding horn 32*a* has no protrusions on its bottom surface 39. Instead, the bottom surface 39 of ultrasonic welding horn 32*a* is smooth. As shown in FIG. 4A, the anvil 42*a* has a plurality of curved projections 41, which together form a projection circle 43. A plurality of projection circles 43 extend upwardly from the generally planar upper surface 45 of anvil 42*a*. When the ultrasonic welding horn 32*a* moves downwardly and sandwiches the plies 22, 24 of fabric between one of the projection circles 43 and the smooth bottom surface 39 of ultrasonic welding horn 32*a*, a circular weld seam 30 is created, as described above. Thus, a plurality of pockets 44 are created by the circular weld seams 30, each pocket 44 containing at least one mini coil spring 28.

Upon being subjected to a load, a pocket 44 containing at least one mini coil spring 28 is compressed by compressing the mini coil spring(s) 28 and air contained within the pocket 44. Air exits the pocket 44 through apertures 25 in the fabric and gaps 31 between the curved weld segments 26 of the circular weld seams 30. Similarly, when a load is removed from the pocket 44, the mini coil spring 28 separates the fabric layers 22, 24, and air reenters the pocket 44 though apertures 25 in the fabric and through the gaps 31 between the curved weld segments 26 of the circular weld seams 30. As shown in FIG. 5, the size of the gaps 31 between the segments 26 of circular seams 30 of perimeter pockets 44 may affect how quickly air may enter or exit the comfort layer 16.

In the present invention the fabric material is permeable to airflow, so the rate at which the mini coil springs 28 compress when a load is applied to a pocketed spring core comfort layer 16 is not slowed or retarded by the air entrapped within the individual pockets as the pocketed spring comfort layer 16 is compressed. Similarly, the rate of return of the compressed coil spring comfort layer to its original height after compression is not retarded or slowed by the rate at which air may pass through the permeable fabric material into the interior of the individual pockets 44 of the pocketed spring comfort layer 16. Air passes through the apertures in the first and second pieces of fabric 22, 24 when the pocket 44 is compressed and when the pocket 44 is unloaded, enlarging or expanding due to the inherent characteristics of the mini springs 28. In addition, air passes through the gaps 31 between the curved weld segments 26 of the circular weld seams 30, as described above.

As best illustrated in FIG. 5, the individual pockets 44 of comfort layer 16 may be arranged in longitudinally extending columns 46 extending from head-to-foot of the bedding product and transversely extending rows 48 extending from side-to-side of the bedding product. As shown in FIGS. 5 and 5A, the individual pockets 44 of one column 46 are aligned with the pockets 44 of adjacent columns 46.

FIGS. 6 and 6A illustrate another comfort layer 50 having the same pockets 44 and same springs 28 as does the embodiment of comfort layer 16 of FIGS. 1-5A. As best illustrated in FIG. 6, the individual pockets 44 of comfort layer 50 are arranged in longitudinally extending columns 52 extending from head-to-foot of the bedding product and transversely extending rows 54 extending from side-to-side of the bedding product. As shown in FIGS. 6 and 6A, the individual pockets 44 of one column 52 are offset from, rather than aligned with, the pockets 44 of the adjacent columns 52.

Figure 7:
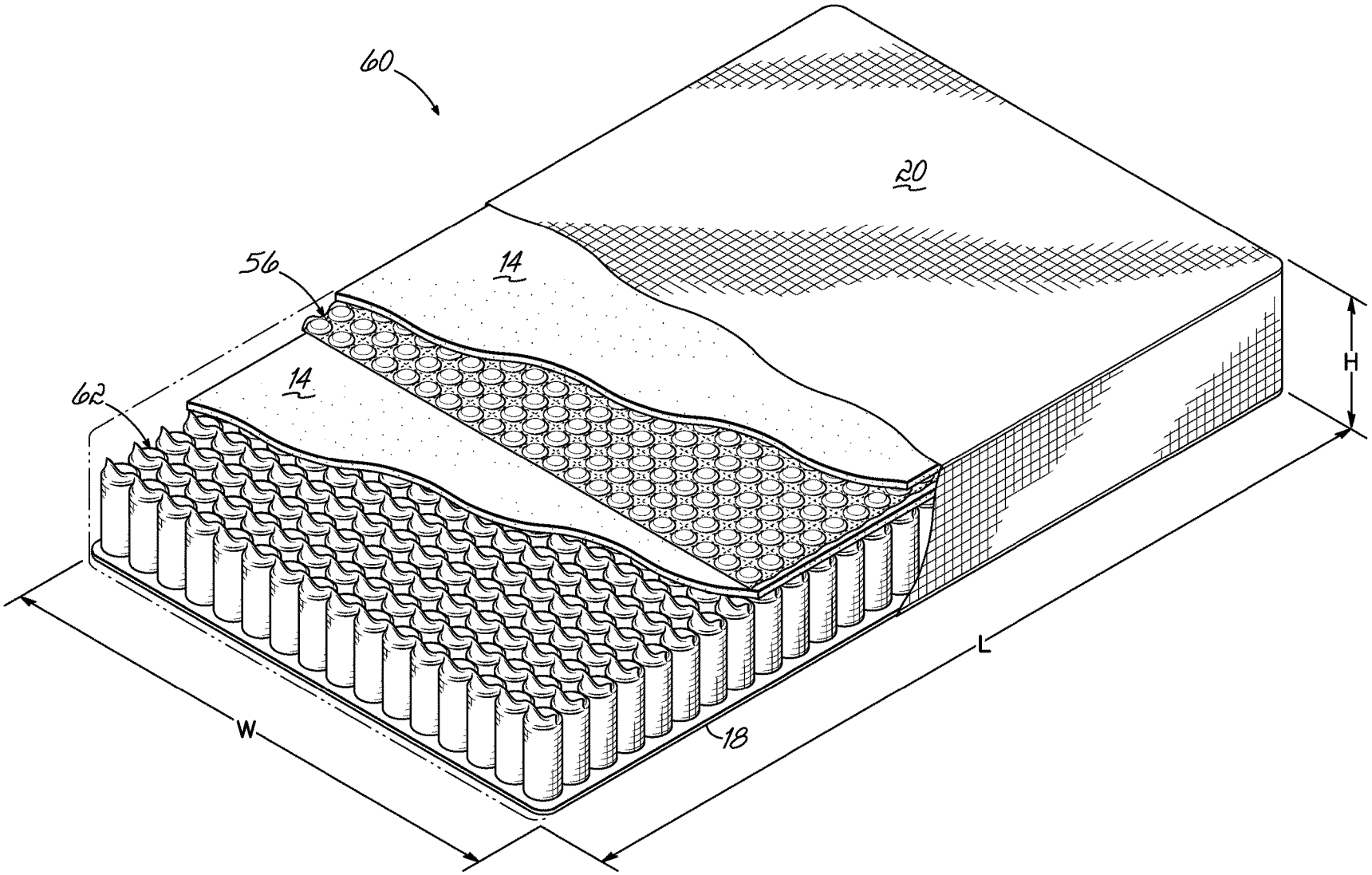
FIG. 7 is a perspective view, partially broken away, of a bedding product incorporating another embodiment of comfort layer in accordance with the present invention.

FIG. 7 illustrates an alternative embodiment of comfort layer 56 incorporated into a single-sided mattress 60. Single-sided mattress 60 comprises a pocketed spring core 62, a cushioning pad 14 on top of the pocketed spring core 62, a base 18, another cushioning pad 14 above comfort layer 56, and an upholstered covering material 20. Pocketed spring core 62 may be incorporated into any bedding or seating product, including a double-sided mattress, and is not intended to be limited to single-sided mattresses. As described above, comfort layer 56 may be used in any conventional core, including a spring core made with non-pocketed conventional springs, such as coil springs.

As shown in FIG. 7, mattress 60 has a longitudinal dimension or length L, a transverse dimension or width W and a height H. Although the length L is shown as being greater than the width W, they may be identical. The length, width and height may be any desired distance and are not intended to be limited by the drawings.

Figure 9:
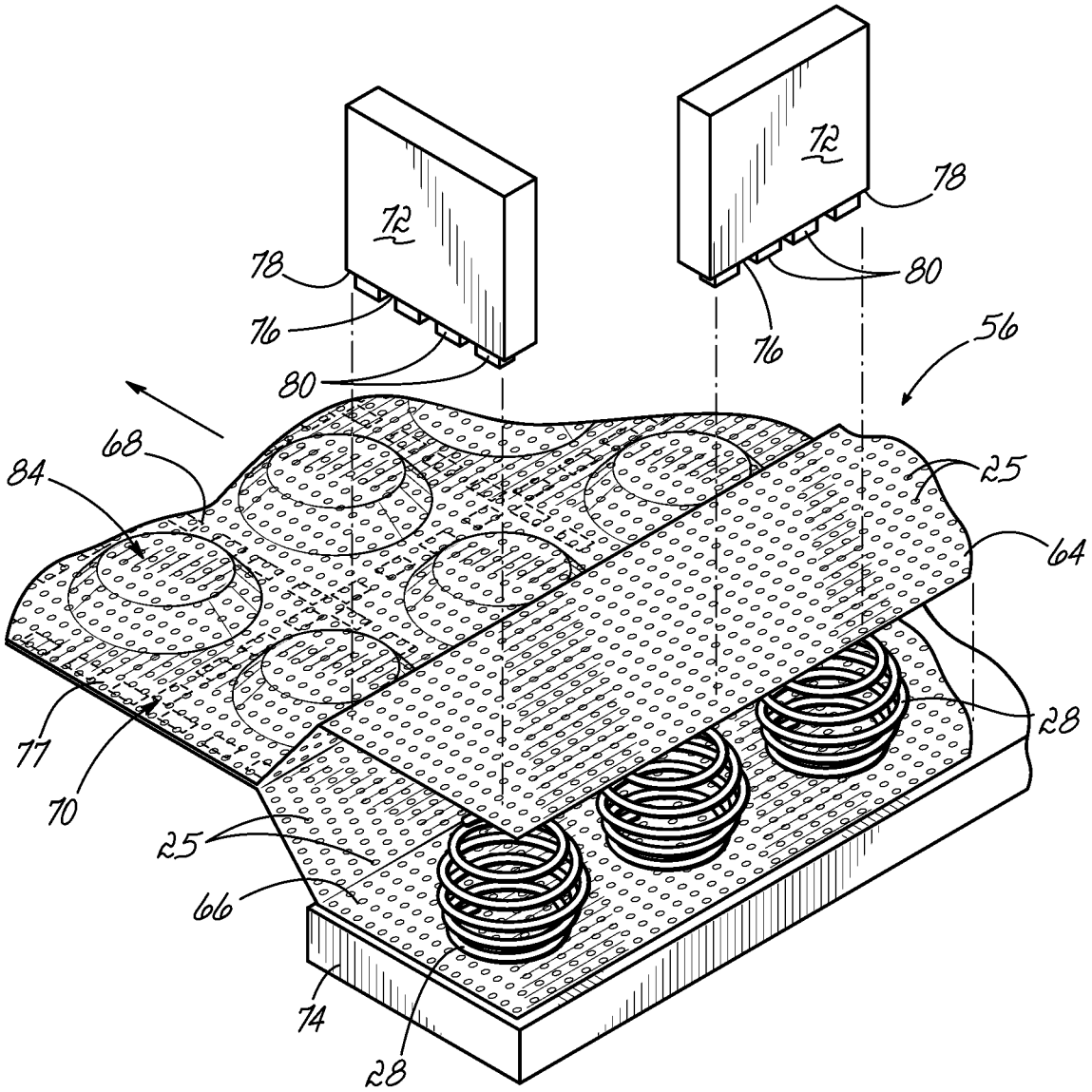
FIG. 9 is an enlarged perspective view of a portion of the comfort layer of FIG. 7 partially disassembled and showing a portion of a welding tool.

FIG. 9 illustrates the components of the comfort layer 56 incorporated into the mattress 60 shown in FIG. 7. The comfort layer 56 comprises a first piece of fabric 64 and a second piece of fabric 66 joined together with multiple linear weld segments 68. The first and second pieces of fabric 64, 66 are made of the same nonwoven spunlaced aperture fabric described herein with respect to first and second pieces of fabric 22, 24. Each of the first and second pieces of fabric 64, 68 is made of nonwoven spunlaced aperture fabric having a pattern of apertures 25 therethrough which allow air to flow quickly through the fabric. One of the apertures 25 is shown in detail in FIG. 18.

The weld segments 68 are strategically placed around a mini coil spring 28 and create a rectangular containment or seam 70. During the welding process, the mini coil springs 28 may be compressed. The length and/or width of the linear weld segments 68 of seams 70 is not intended to be limited to those illustrated; they may be any desired size depending upon the airflow desired through the comfort layer. Similarly, the size of the illustrated seams 70 is not intended to be limiting. Shapes other than linear weld segments may be used to create rectangular seams. Such shapes may include, but are not limited to, triangles or circles or ovals of any desired size and pattern to obtain the desired airflow between adjacent pockets and into or out of the perimeter of the comfort layer.

With reference to FIG. 9, there is illustrated a portion of an ultrasonic welding horn 72 and anvil 74. The mobile or movable ultrasonic welding horn 72 has a plurality of spaced cut-outs or slots 76 between projections 80. The projections 80 of the ultrasonic welding horn 72 are the portions which weld the two pieces of fabric 64, 66 together and create the linear weld segments 68 in rectangular weld seams 70. Along the ultrasonic welding horn's lower portion 78, the ultrasonic welding horn 72 can be milled to allow a desired airflow between the linear weld segments 68 as illustrated by the arrows 82 of FIG. 7. The airflows affect the feel/compression of the individually pocketed mini coil springs 28 when a user lays on the mattress 60.

As shown in FIG. 9, underneath the second piece of fabric 66 is an anvil 74 comprising a steel plate of $3/8^{th}$ inch thickness. However, the anvil may be any desired thickness. During the manufacturing process, the ultrasonic welding horn 72 contacts the anvil 74, the two pieces of fabric 64, 66 being therebetween, to create the rectangular weld seams 70 and, hence, pockets 84, at least one mini coil spring 28 being in each pocket 84. See FIGS. 10 and 10A.

Figure 10:
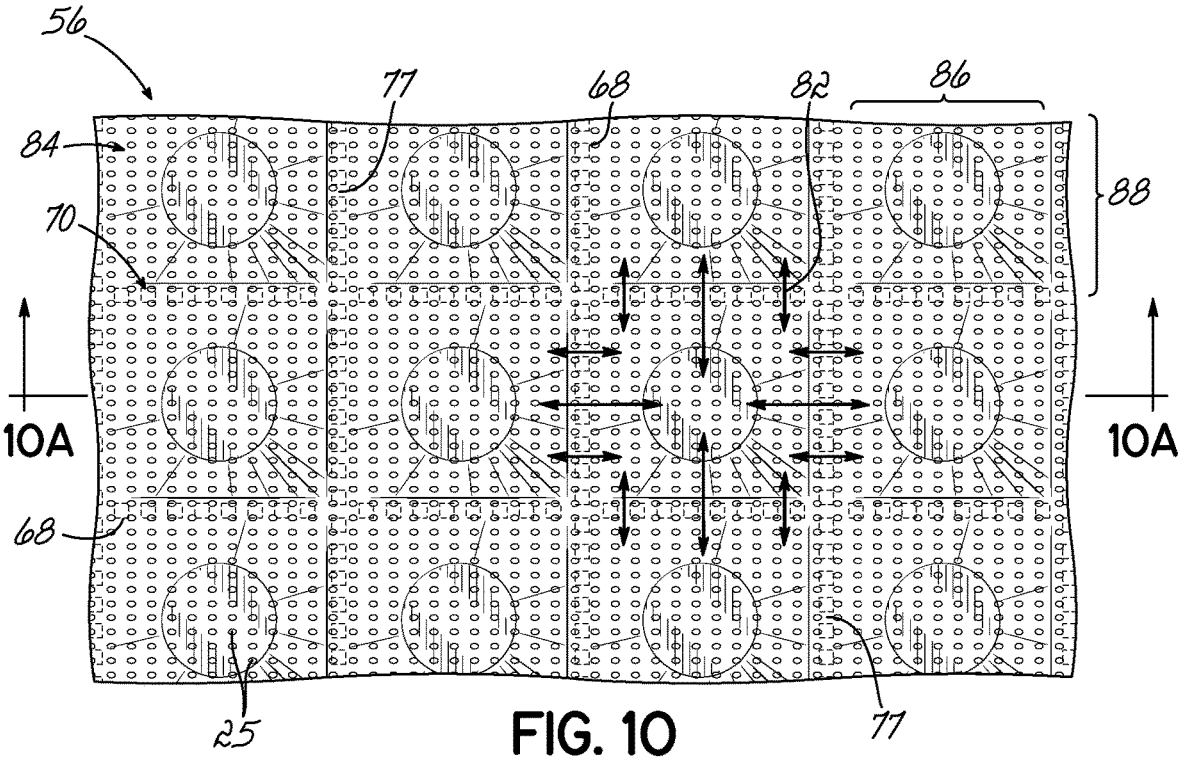
FIG. 10 is a top plan view of a portion of the comfort layer of FIG. 7, the arrows showing airflow inside the comfort layer.

These linear weld segments 68 may be created by the welding horn 72 of a machine (shown in FIG. 8 and described below) having multiple spaced protrusions 80 on the ultrasonic welding horn 72. As a result of these rectangular weld seams 70 defining the spring-containing pockets 84 of the comfort layer 56, each mini coil spring 28 is contained within its own individual pocket 84. Air exits the pocket 84 through gaps 77 between the weld segments 68 of the rectangular weld seams 30. Similarly, when a load is removed from the pocket 84, the mini coil spring 28 separates the fabric layers 64, 66, and air reenters the pocket 84 though the gaps 77 between the weld segments 68 of the rectangular weld seams 70. As shown in FIG. 10, the size of the gaps 77 between the segments 68 of rectangular weld seams 70 of the pockets 84 may assist how quickly air may enter or exit the comfort layer 56.

Figure 9A:
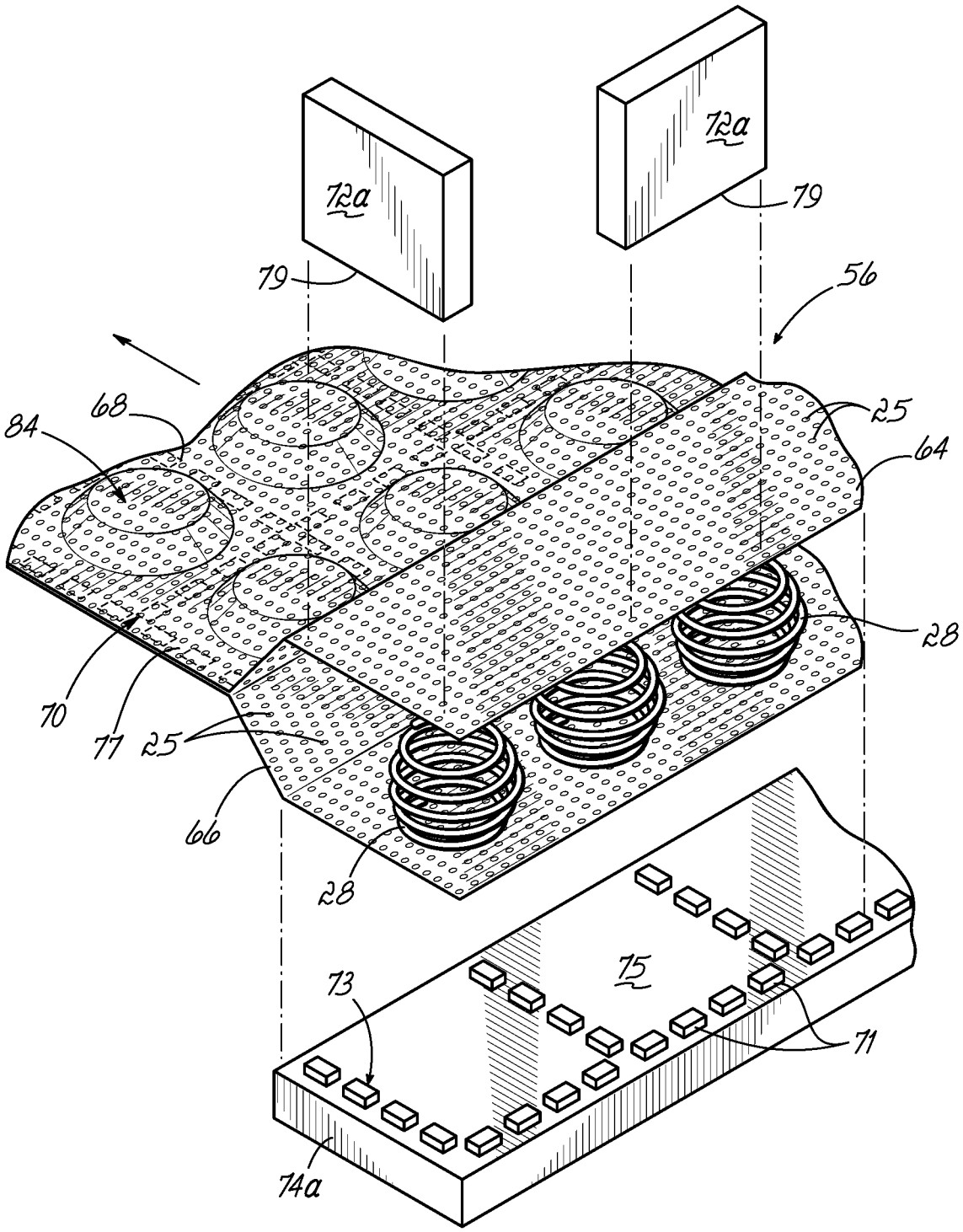
FIG. 9A is an enlarged perspective view of a portion of the comfort layer of FIG. 7 partially disassembled and showing a portion of another welding tool.

FIG. 9A illustrates another apparatus for forming the rectangular weld seams 70 comprising multiple linear weld segments 68 having gaps 77 therebetween for airflow. In this apparatus, the ultrasonic welding horn 72*a* has no protrusions on its bottom surface 79. Instead, the bottom surface 79 of ultrasonic welding horn 72*a* is smooth. The anvil 74*a* has a plurality of linear projections 71, which together form a projection pattern 73, shown in FIG. 9A. A plurality of spaced projections 71 in pattern 73 extend upwardly from the generally planar upper surface 75 of anvil 74*a*. When the ultrasonic welding horn 72*a* moves downwardly and sandwiches the pieces 64, 66 of fabric between the projections 71 and the smooth bottom surface 79 of ultrasonic welding horn 72*a*, rectangular weld seams 70 are created. Thus, a plurality of pockets 84 are created by the rectangle weld seams 70, each pocket 84 containing at least one mini coil spring 28.

In accordance with the practice of this invention, one fabric material permeable to airflow, which may be used in either of the two pieces of the pocketed spring comfort layers disclosed or shown herein, may be a nonwoven spunlaced aperture fabric with apertures 25.

In an air permeability test known in the industry as the ASTM Standard D737, 2004 (2012), "Standard Test Method for Air Permeability of Textile Fabrics," ASTM International, West Conshohocken, Pa. 2010, airflow through the permeable ten-mesh nonwoven spunlaced aperture fabric available from Hangzhou Nbond Nonwoven Company, Limited of China described above was measured. The average result was approximately 477 cubic feet per minute ("CFM"). Using the same test with semi-impermeable fabric available from Hanes Industries of Conover, N.C. disclosed in U.S. Pat. No. 9,943,173 resulted in a range of between 0.029 and 0.144 CFM. Using the same test with conventional nonwoven spunbond polypropylene bedding fabric resulted in an average of 146 CFM.

As these test results show, air flows much quicker and easier through the nonwoven spunlaced aperture fabric of the present invention compared to the semi-impermeable fabric available from Hanes Industries of Conover, N.C. disclosed in U.S. Pat. No. 9,943,173. Using such test data, air flows through the ten-mesh nonwoven spunlaced aperture fabric over one thousand times quicker than the semi-impermeable fabric described available from Hanes Industries of Conover, N.C. disclosed in U.S. Pat. No. 9,943,173. Using the same test data, air flows through the ten-mesh nonwoven spunlaced aperture fabric over four times quicker than conventional nonwoven spunbond polypropylene bedding fabric.

Figure 10A:
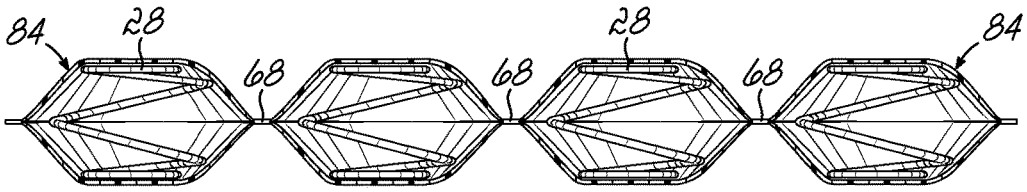
FIG. 10A is a cross-sectional view taken along the line 10A-10A of FIG. 10.

As best illustrated in FIG. 10, the individual pockets 84 of comfort layer 56 may be arranged in longitudinally extending columns 86 extending from head-to-foot of the bedding product and transversely extending rows 88 extending from side-to-side of the bedding product. As shown in FIGS. 10 and 10A, the individual pockets 84 of one column 86 are aligned with the pockets 84 of the adjacent columns 86. Air may flow between pockets 84 and into and out of the comfort layer 56 between the linear segments 68 of seams 70.

Figure 11:
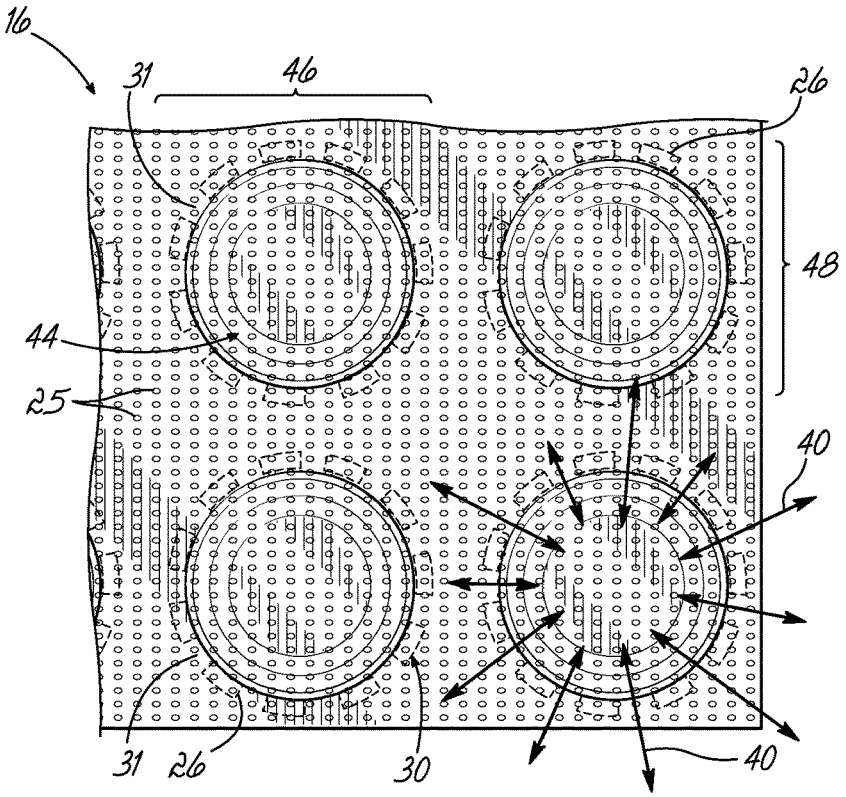
FIG. 11 is a top plan view of a corner portion of the comfort layer of FIG. 1, the arrows showing airflow into and out of the comfort layer.

FIG. 11 illustrates one corner of comfort layer 16 of mattress 10 showing airflow between the curved weld segments 26 of the peripheral pockets 44, as illustrated by the arrows 40. Although FIG. 11 illustrates the arrows 40 only on one corner pocket 44, each of the pockets 44 around the periphery of the comfort layer 16 allows airflow through the gaps 31 between the weld segments 26 of circular seams 30.

This airflow affects the amount of air entering the comfort layer 16 when a user changes position or gets off the bedding or seating product, thus allowing the springs 28 in the pockets 44 to expand and air to flow into the comfort layer 16. Similarly, when a user gets onto a bedding or seating product, the springs 28 compress and cause air to exit the pockets 44 around the periphery of the comfort layer 16 and exit the comfort layer. The amount of air exiting the comfort layer 16 affects the feel/compression of the individually pocketed mini coil springs 28 when a user lays on the mattress 10.

Figure 11A:
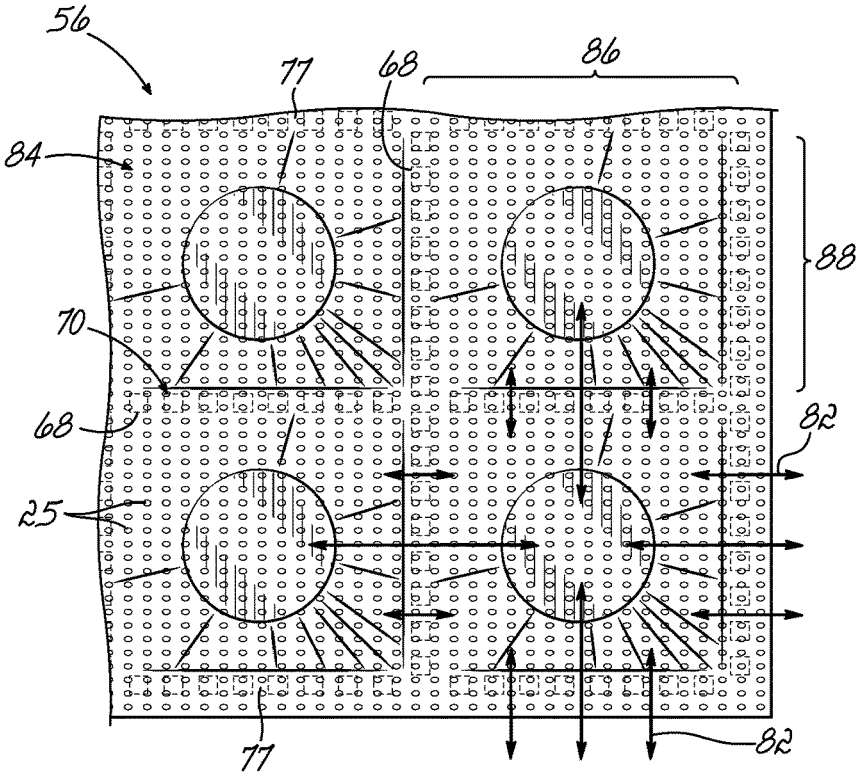
FIG. 11A is a top plan view of a corner portion of the comfort layer of FIG. 7, the arrows showing airflow into and out of the comfort layer.

FIG. 11A illustrates one corner of comfort layer 56 of mattress 60 of FIG. 7 showing airflow between the weld segments 68 of the peripheral pockets 84, as illustrated by the arrows 82. Although FIG. 11A illustrates the arrows 82 only on one corner pocket 84, each of the pockets 84 around the periphery of the comfort layer 56 allows airflow through the gaps 77 between the weld segments 68 of rectangular seams 70. This airflow affects the amount of air entering the comfort layer 56 when a user changes position or gets off the bedding or seating product, thus allowing the springs 28 in the pockets 84 to expand and air to flow into the comfort layer 56. Similarly, when a user changes position or gets onto a bedding or seating product, the springs 28 compress and cause air to exit the pockets 84 around the periphery of the comfort layer 16 and exit the comfort layer. The amount of air exiting the comfort layer 56 affects the feel/compression of the individually pocketed mini coil springs 28 when a load is applied to the mattress 10.

Figure 12:
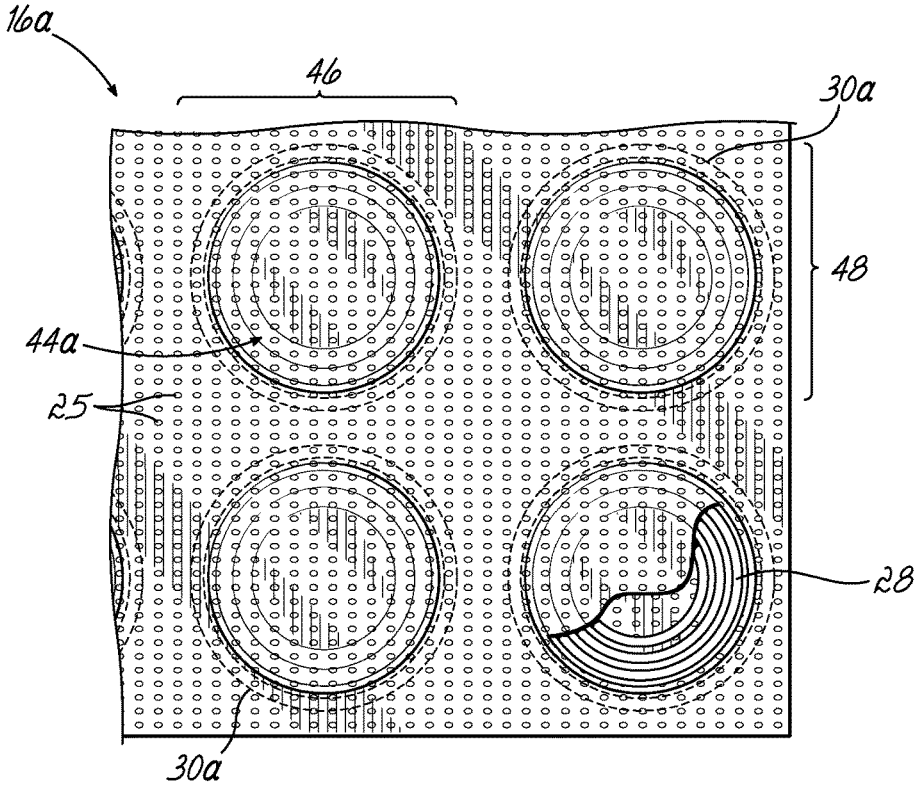
FIG. 12 is a top plan view of a corner portion of another embodiment of comfort layer.

FIG. 12 illustrates one corner of an alternative embodiment of comfort layer 16*a*, which may be used in any bedding or seating product. The comfort layer 16*a* comprises aligned rows 48 and columns 46 of pockets 44*a*, each pocket 44*a* comprising a circular seam 30*a* joining upper and lower plies of fabric, as described above. However, each of the circular seams 30*a* is a continuous seam, as opposed to a seam having curved weld segments with gaps therebetween to allow airflow through the circular seam. These circular seams 30*a* of pockets 44*a* allow no airflow through the seams 30*a*. Therefore, the fabric material of the first and second plies of pockets 44*a* of comfort layer 16*a* must be made of permeable material to allow airflow into and out of the pockets 44*a* of comfort layer 16*a*. The type of material used for comfort layer 16*a* solely controls the amount of air entering the comfort layer 16*a* when a user gets off the bedding or seating product, thus allowing the springs 28 in the pockets 44*a* to expand and air to flow into the comfort layer 16*a*. Similarly, when a user gets onto a bedding or seating product, the springs 28 compress and cause air to exit the pockets 44*a* of the comfort layer 16*a* and exit the comfort layer. The amount of air exiting the comfort layer 16*a* affects the feel/compression of the individually pocketed mini coil springs 28 when a user lays on the product incorporating the comfort layer 16*a*.

Figure 12A:
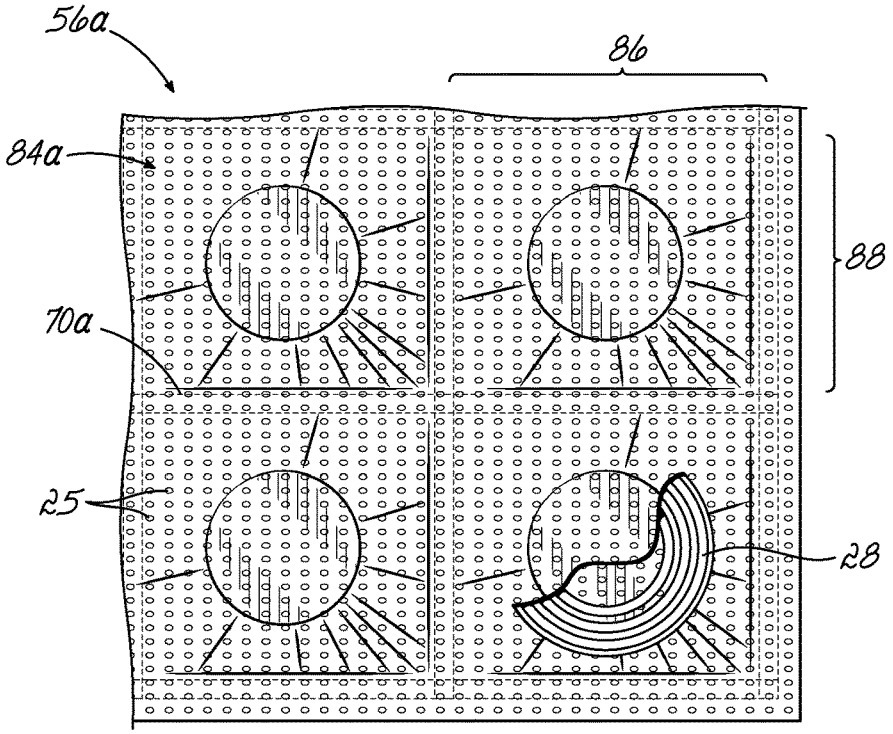
FIG. 12A is a top plan view of a corner portion of another embodiment of comfort layer.

FIG. 12A illustrates one corner of an alternative embodiment of comfort layer 56*a*, which may be used in any bedding or seating product. The comfort layer 56*a* comprises aligned rows 88 and columns 86 of pockets 84*a*, each pocket 84*a* comprising a rectangular seam 70*a* joining upper and lower plies of fabric as described above. However, each of the rectangular seams 70*a* is a continuous seam, as opposed to a seam having weld segments with gaps therebetween to allow airflow through the seam. These rectangular seams 70*a* of pockets 84*a* allow no airflow through the seams 70*a*. Therefore, the fabric material of the first and second plies of pockets 84*a* of comfort layer 56*a* must be made of permeable material to allow airflow into and out of the pockets 84*a* of comfort layer 56*a*. The type of material used for comfort layer 56*a* solely controls the amount of air entering the comfort layer 56*a* when a user gets off the bedding or seating product, thus allowing the springs 28 in the pockets 84*a* to expand and air to flow into the comfort layer 56*a*. Similarly, when a user gets onto a bedding or seating product, the springs 28 compress and cause air to exit the pockets 84*a* of the comfort layer 56*a* and exit the comfort layer. The amount of air exiting the comfort layer 56*a* affects the feel/compression of the individually pocketed mini coil springs 28 when a user lays on the product incorporating the comfort layer 56*a*.

Figure 2:
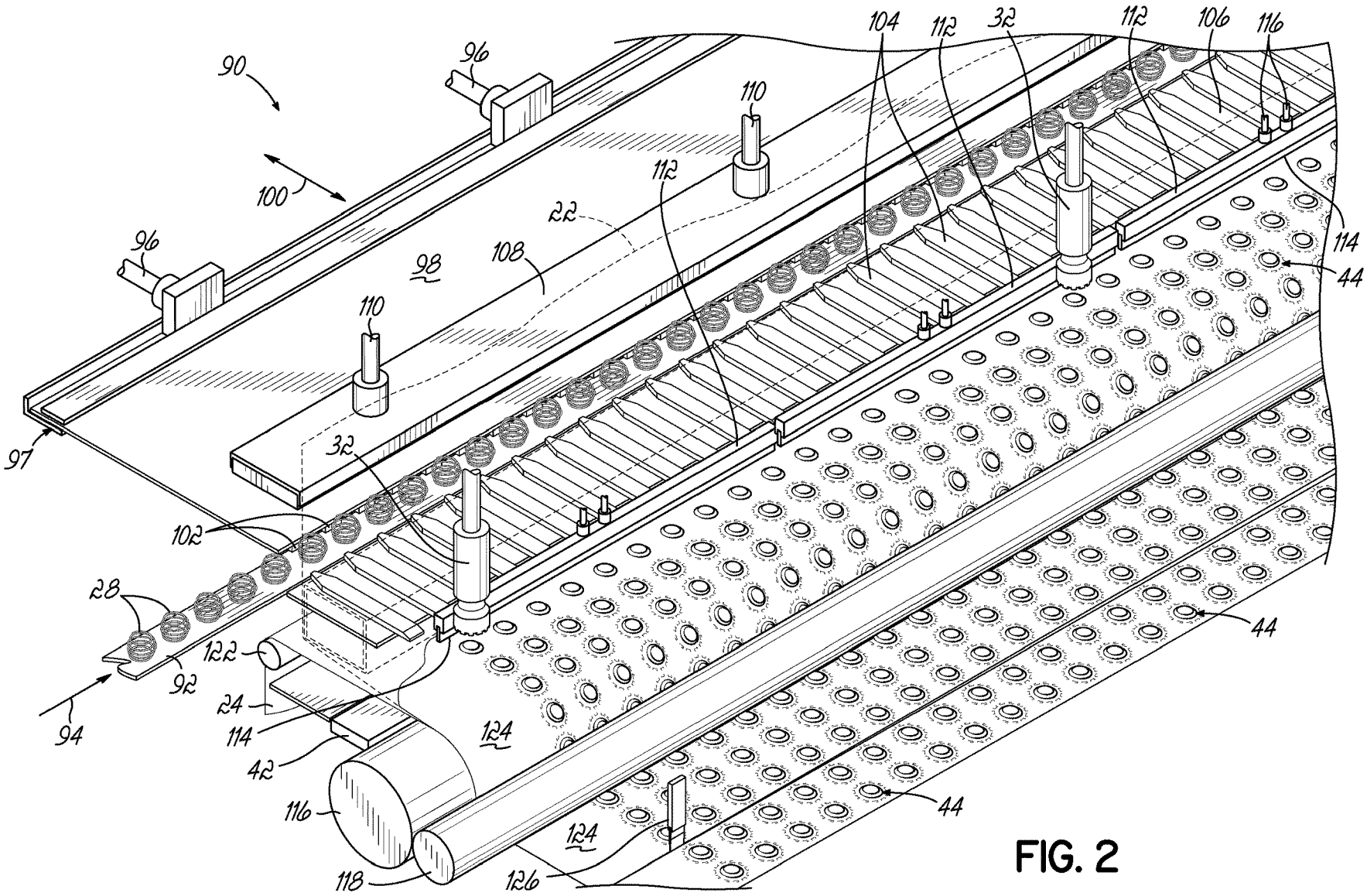
FIG. 2 is a perspective view of the comfort layer of FIG. 1 being manufactured.

FIG. 2 illustrates a machine 90 used to make several of the comfort layers shown and disclosed herein, including comfort layer 16 shown in FIG. 1. Some parts of the machine 90 may be changed to make other comfort layers shown or described herein, such as comfort layer 56 shown in FIG. 7. Machine 90 comprises a pair of ultrasonic welding horns 32, and at least one stationary anvil 42, as shown in FIG. 4. Alternatively, ultrasonic welding horns 32*a* and anvil 42*a* of FIG. 4A may be used in the machine.

Figure 2A:
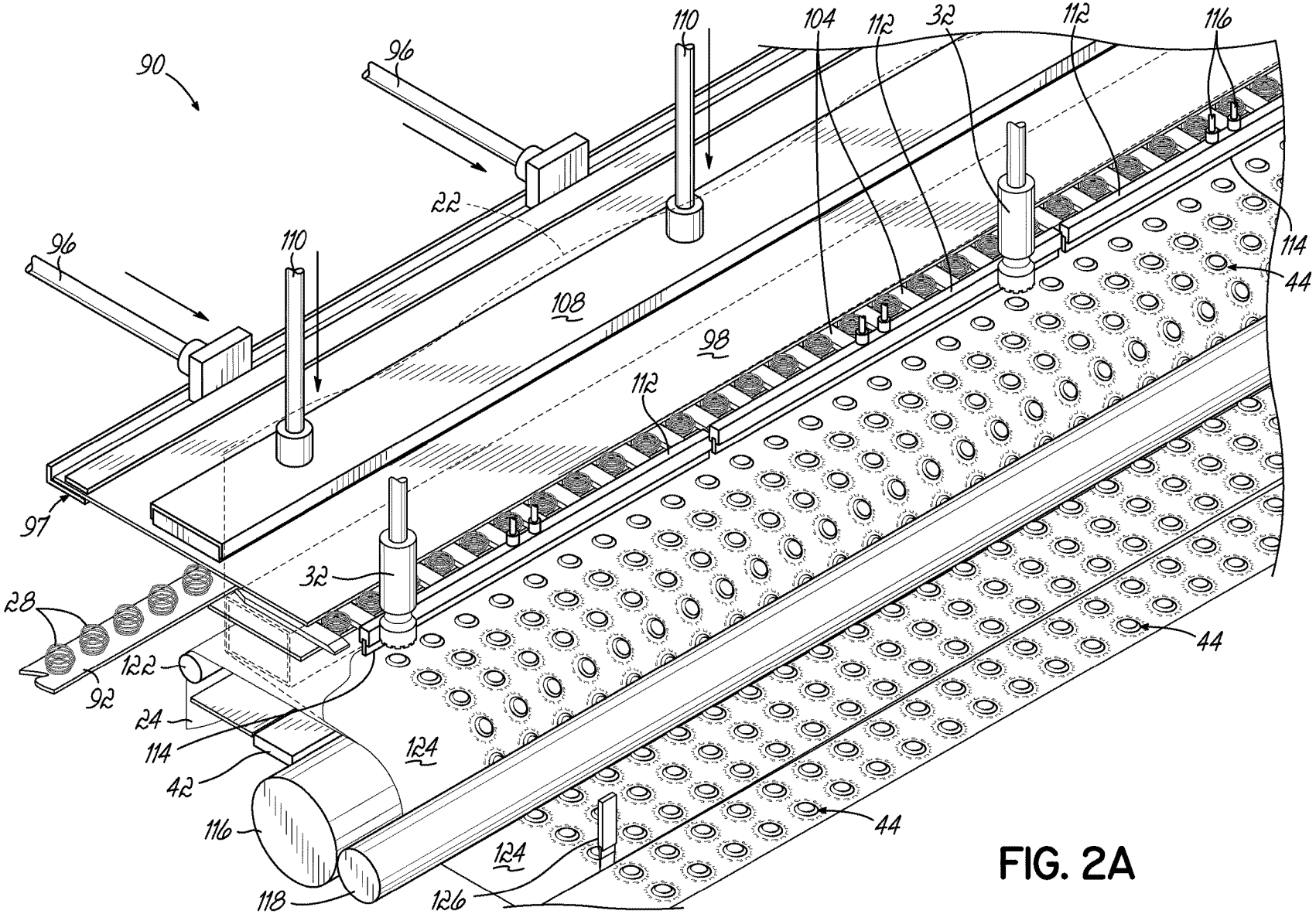
FIG. 2A is a perspective view of a portion of the machine of FIG. 2, the mini coil springs being inserted into predetermined positions.

Machine 90 discloses a conveyor 92 on which are loaded multiple mini coil springs 28. The conveyor 92 moves the mini coil springs 28 in the direction of arrow 94 (to the right as shown in FIG. 2) until the mini coil springs 28 are located in predetermined locations, at which time the conveyor 92 stops moving. Machine 90 further discloses several actuators 96, which move a pusher assembly 97, including a pusher plate 98 in the direction of arrow 100. Although two actuators 96 are illustrated in FIGS. 2 and 2A, any number of actuators 96 of any desired configuration may be used to move the pusher assembly 97. The pusher plate 98 has a plurality of spaced spring pushers 102 secured to the pusher plate 98 underneath the pusher plate 98. The spring pushers 102 push the mini coil springs 28 between stationary guides 104 from a first position shown in FIG. 2 to a second position shown in FIG. 4 in which the mini coil springs 28 are located above the stationary anvil 42 (or above the alternative anvil 42*a* shown in FIG. 4A). FIG. 2A illustrates the mini coil springs 28 being transported from the first position to the second position, each mini coil spring 28 being transported between adjacent stationary guides 104. The stationary guides 104 are secured to a stationary mounting plate 106.

The machine 90 further comprises a compression plate 108, which is movable between raised and lowered positions by lifters 110. Although two lifters 110 are illustrated in FIGS. 2 and 2A, any numbers of lifters 110 of any desired configuration may be used to move the compression plate 108.

Figure 3A:
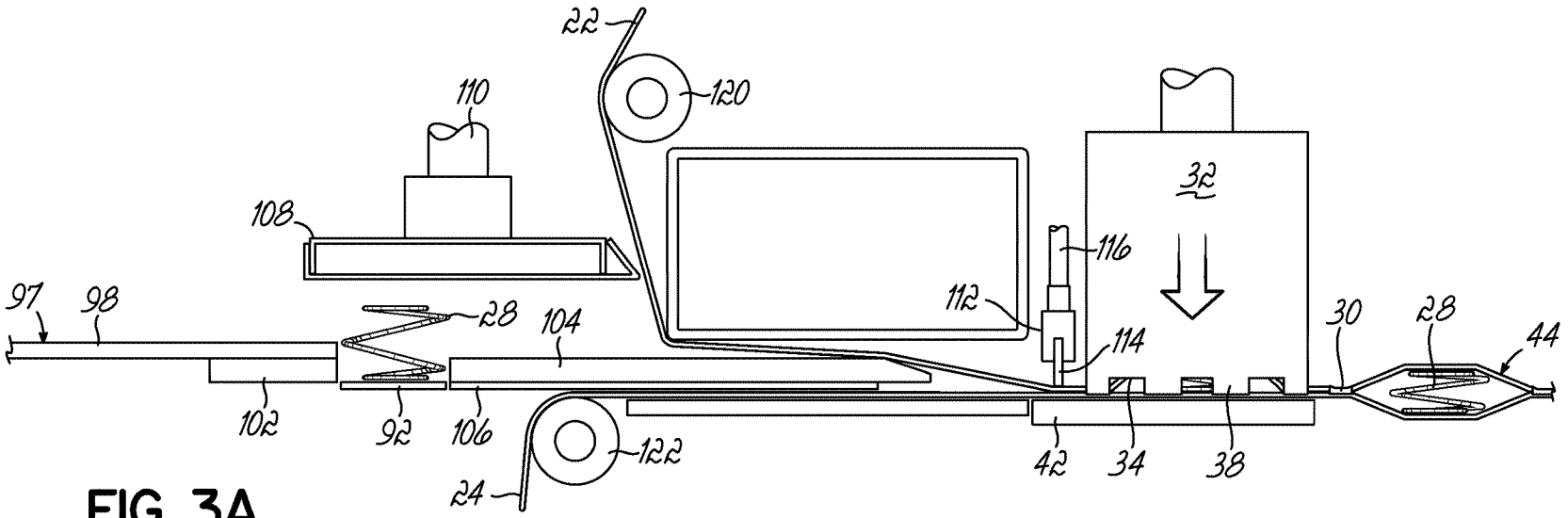
FIG. 3A is a cross-sectional view of a beginning portion of the manufacturing process using the machine of FIGS. 2 and 2A.
Figure 3B:
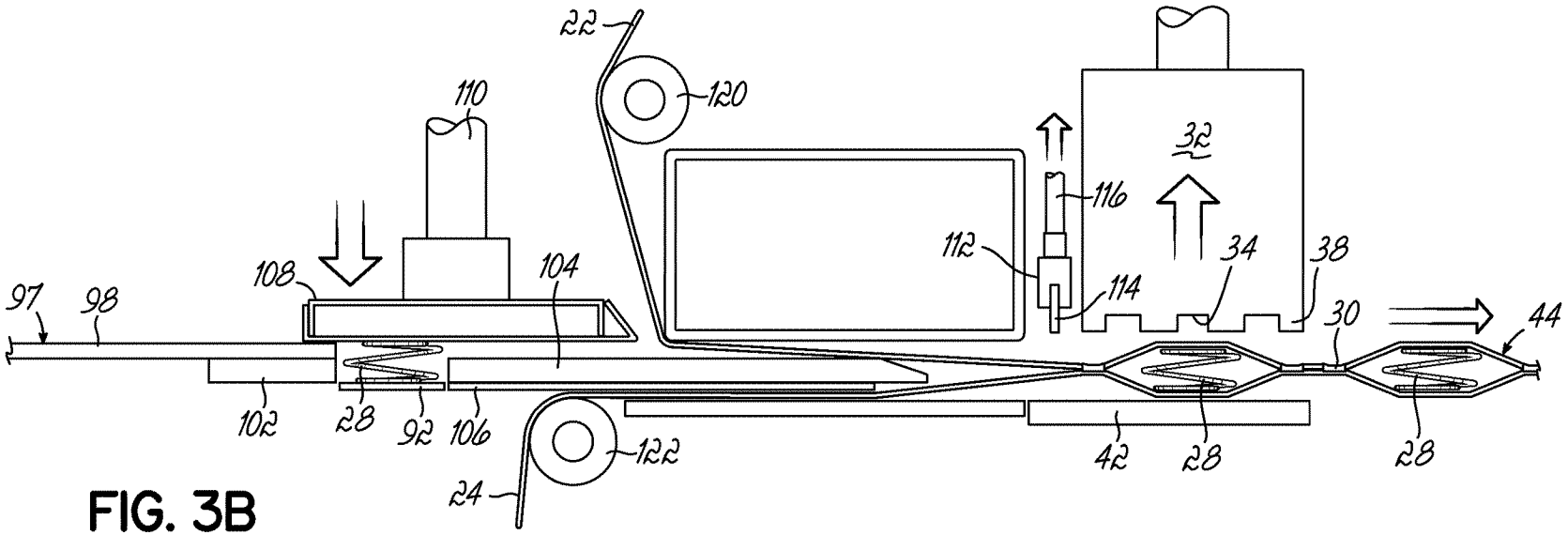
FIG. 3B is a cross-sectional view of the springs being compressed in the manufacturing process using the machine of FIGS. 2 and 2A.
Figure 3C:
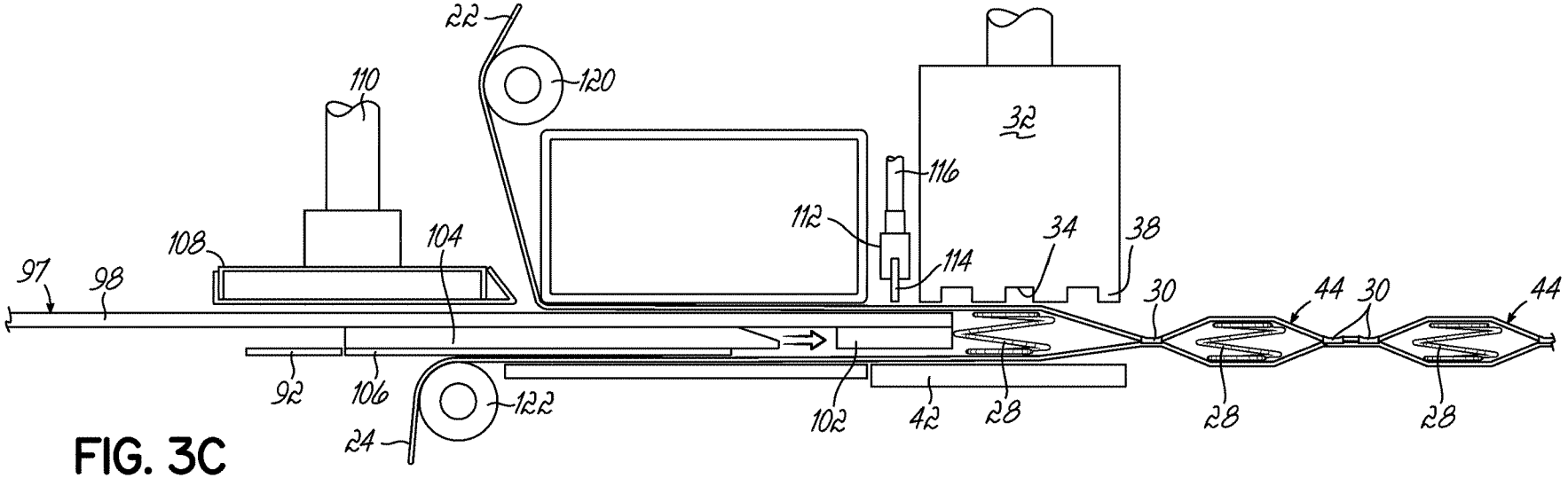
FIG. 3C is a cross-sectional view of the springs being laterally moved in the manufacturing process using the machine of FIGS. 2 and 2A.
Figure 3D:
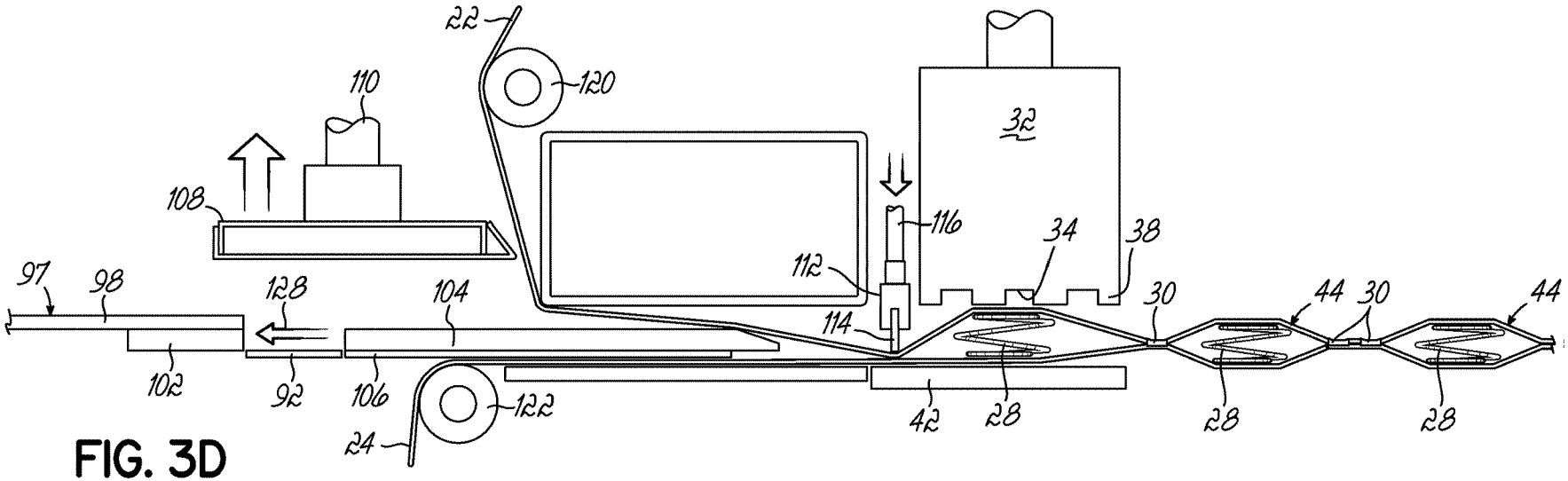
FIG. 3D is a cross-sectional view of the upper ply of fabric being moved in the manufacturing process using the machine of FIGS. 2 and 2A.
Figure 3E:
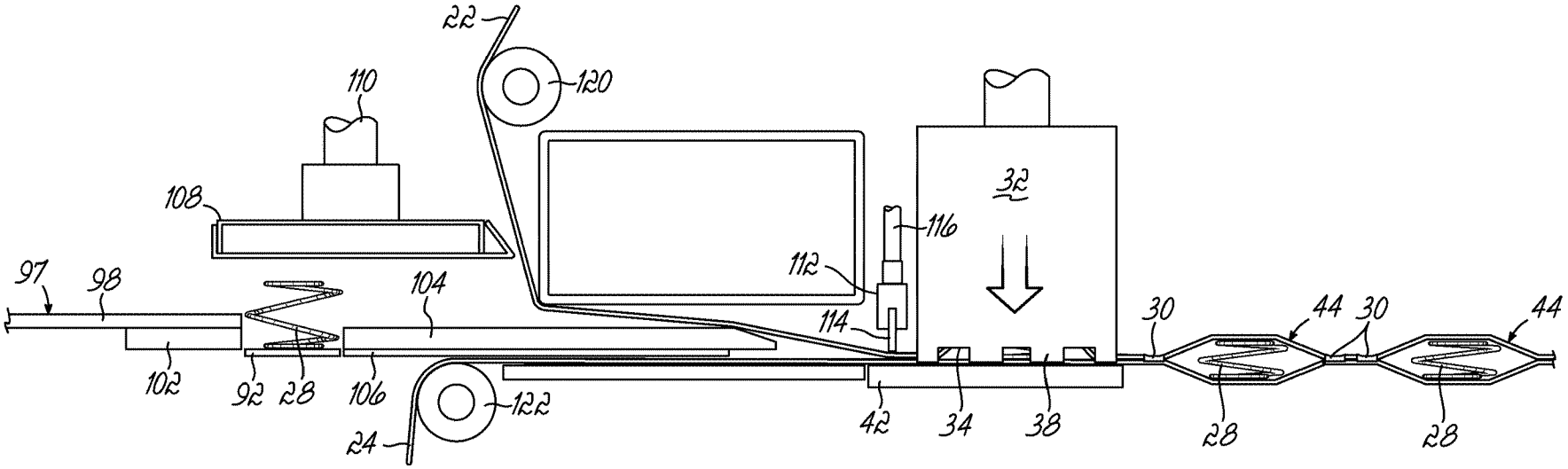
FIG. 3E is a cross-sectional view of one of the springs being sealed in the manufacturing process using the machine of FIGS. 2 and 2A.

As best shown in FIG. 2, machine 90 further comprises three pressers 112 movable between raised and lowered positions via actuators 116. FIGS. 3B and 3C show one of the pressers 112 in a raised position, while FIGS. 3A, 3D and 3E show the presser in a lowered position. Each presser has a blade 114 at the bottom thereof for bringing the plies 22, 24 of fabric together when the presser is lowered, as shown in FIGS. 3A, 3D and 3E.

As best shown in FIG. 3A, machine 90 further comprises rollers 120, 122 around which the plies, 22, 24 respectively pass before they come together. After the circular seams 30 are created by the ultrasonic welding horn 32 and anvil 42, thereby creating the pockets 44, a main roller 116 and secondary roller 118 pull the continuous spring blanket 124 downwardly. Once a desired amount of continuous spring blanket 124 is made, a blade 126 cuts the continuous spring blanket 120 to create comfort layer 16 of the desired size. Of course, the machine 90 may be programmed to create the desired length and width of comfort layer. This machine 90 is adapted to make any of the comfort layers shown or disclosed herein having circular weld seams.

FIG. 3A illustrates the ultrasonic welding horn 32 in a lowered position contacting the stationary anvil 42 with at least one of the pressers 112 in a lowered position pressing the upper ply 22 into contact with the lower ply 24. A new row of mini coil springs 28 has been moved into a loading position with the compression plate 108 in its raised position.

FIG. 3B illustrates the ultrasonic welding horn 32 in a raised position spaced from the anvil 42 with at least one of the pressers 112 in a raised position. The compression plate 108 is moved to its lowered position by lifters 110, thereby compressing the row of mini coil springs 28 located on the conveyor 92.

FIG. 3C illustrates the row of compressed mini coil springs 28 located on the conveyor 92 being pushed downstream towards the ultrasonic welding horn 32 and stationary anvil 42 by the pusher assembly 97. More particularly, the pushers 102 secured to the pusher plate 98 contact the compressed mini coil springs 28 and move them downstream between the stationary guides 104 and past the raised pressers 112.

FIG. 3D illustrates the pusher assembly 97 being withdrawn in the direction of arrow 128. Additionally, the pressers 112 are moved to a lowered position pressing the upper ply 22 into contact with the lower ply 24. Also, the compression plate 108 is moved to its raised position by lifters 110.

FIG. 3E illustrates the ultrasonic welding horn 32 in a lowered position contacting the stationary anvil 42 with at least one of the pressers 112 in a lowered position pressing the upper ply 22 into contact with the lower ply 24. A new row of mini coil springs 28 has been moved by the conveyor 92 into a position in which they may be compressed with the compression plate 108 during the next cycle.

Figure 8:
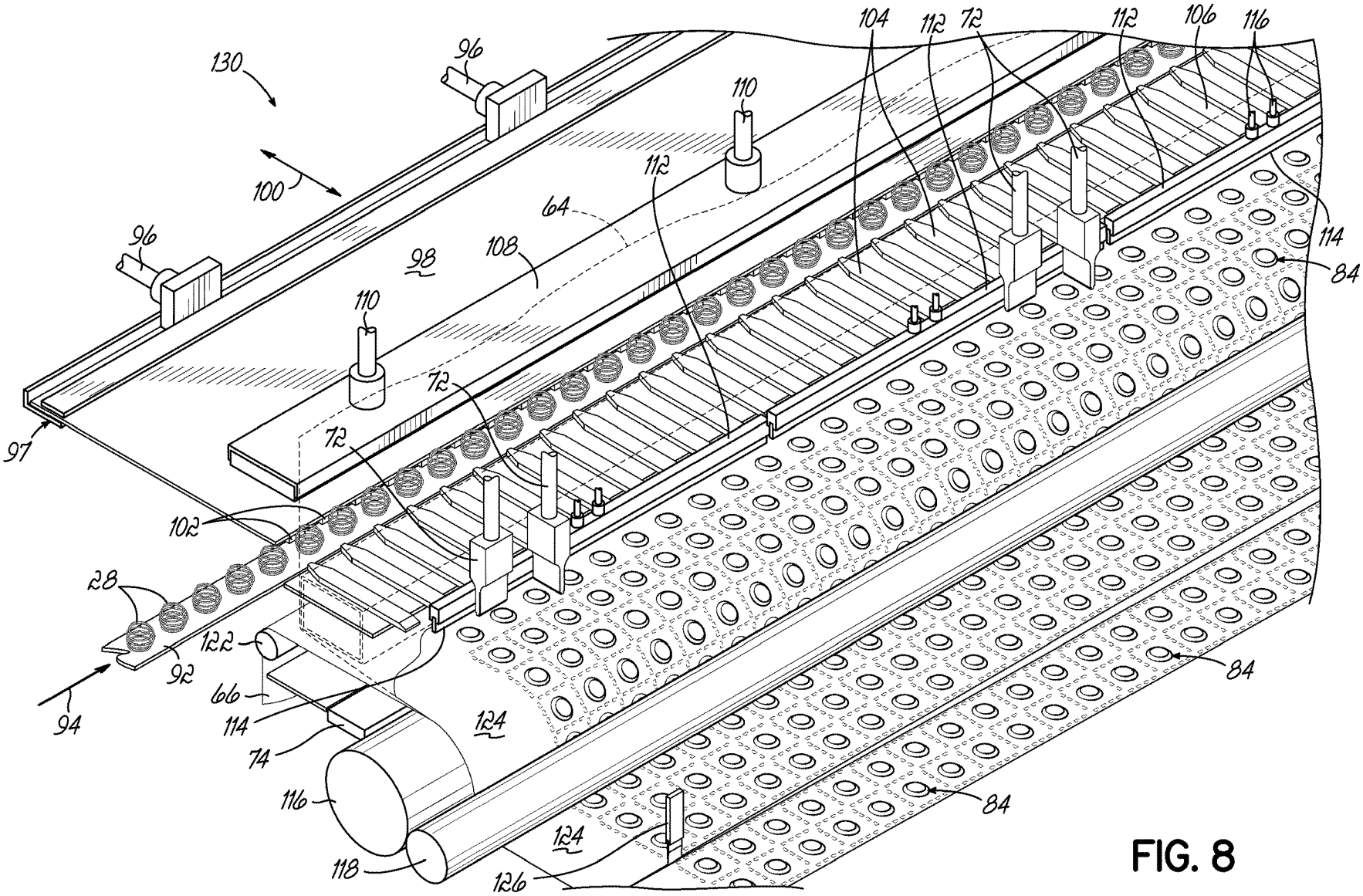
FIG. 8 is a perspective view of the comfort layer of FIG. 7 being manufactured.

FIG. 8 illustrates a machine 130, like the machine 90 shown in FIGS. 2 and 2A. However, instead of having two ultrasonic welding horns 32, machine 130 has four ultrasonic welding horns 72 along with anvil 74. Alternatively, ultrasonic welding horns 72*a* and anvil 74*a* of FIG. 9A may be used in machine 130. This machine 130 is adapted to make any of the comfort layers shown or disclosed herein having rectangular weld seams, as opposed to circular weld seams.

Figure 13A:
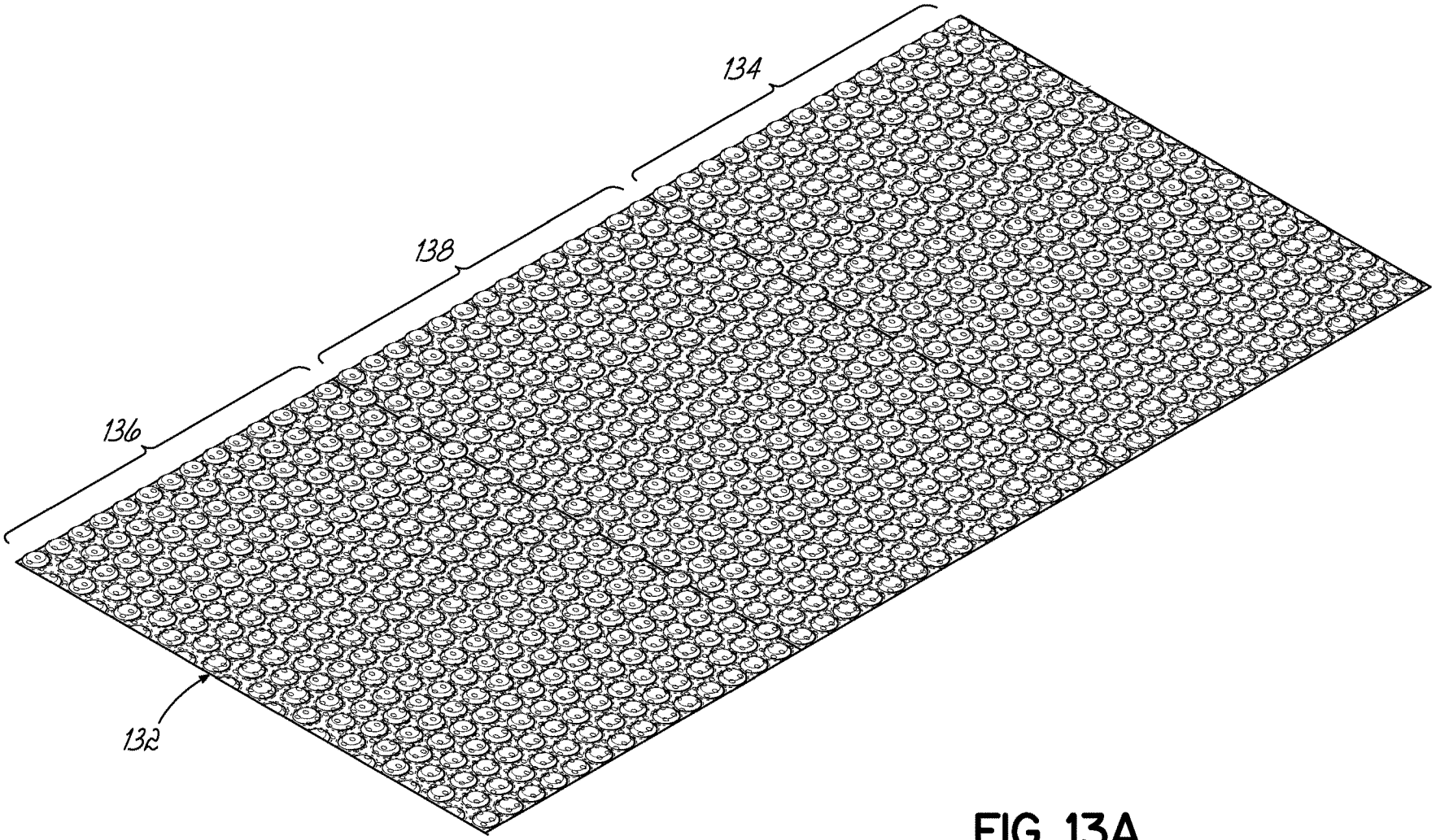
FIG. 13A is a perspective view of a posturized comfort layer.

FIG. 13A illustrates a posturized comfort layer 132 having three different areas or regions of firmness depending upon the airflow within each of the areas or regions. The comfort layer 132 has a head section 134, a foot section 136 and a lumbar or middle section 138 therebetween. The size and number of segments in the seams, along with the type of material used to construct the posturized comfort layer 132, may be selected so at least two of the sections may have a different firmness due to different airflows within different sections. Although three sections are illustrated in FIG. 13A, any number of sections may be incorporated into a posturized comfort layer. Although each of the sections is illustrated being a certain size, they may be other sizes. The drawings are not intended to be limiting. Although FIG. 13A shows each of the segmented seams of comfort layer 132 being circular, a posturized comfort layer, such as the one shown in FIG. 13A, may have rectangular or square segmented seams.

Figure 13B:
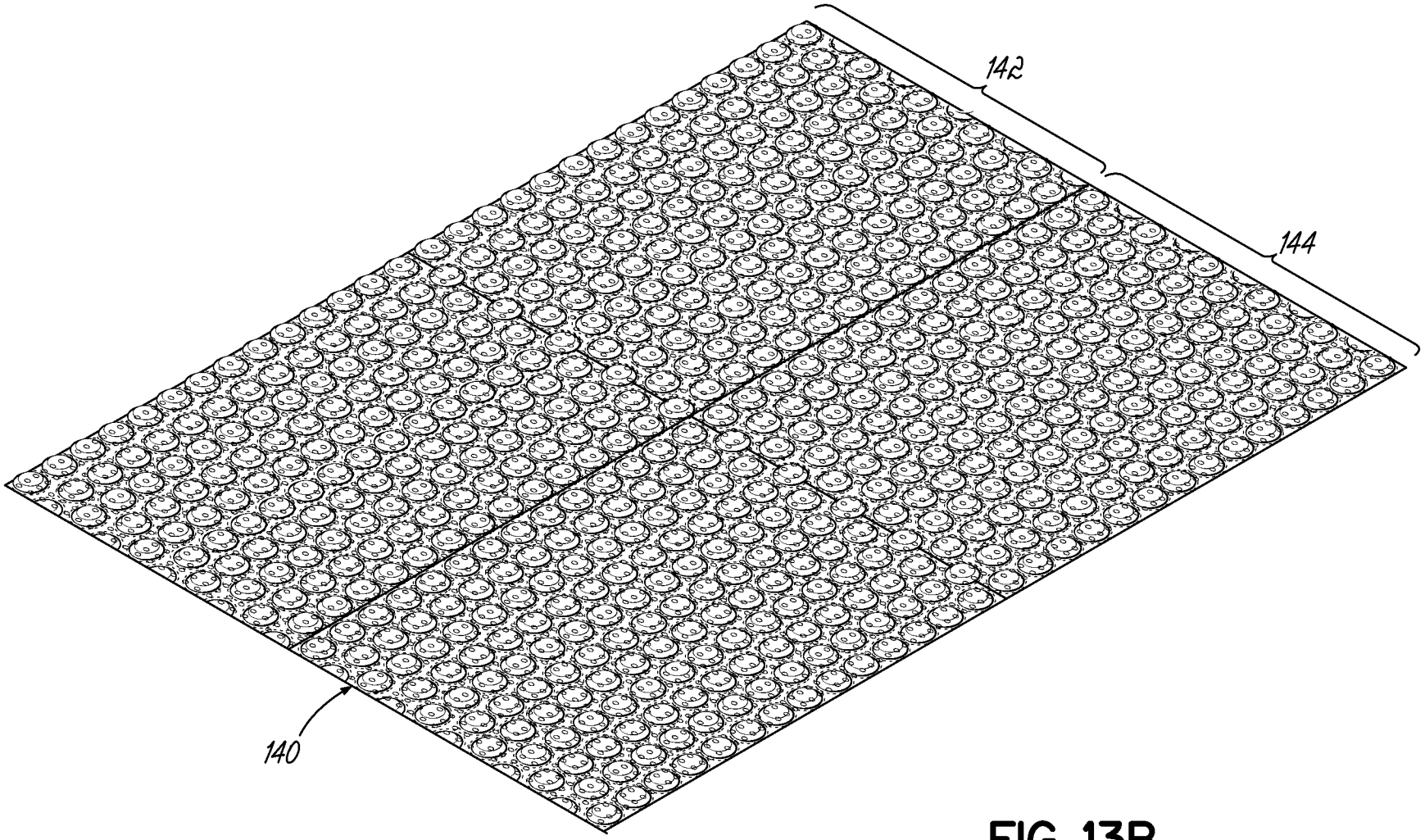
FIG. 13B is a perspective view of another posturized comfort layer.

FIG. 13B illustrates a posturized comfort layer 140 having two different areas or regions of firmness depending upon the airflow within each of the areas or regions. The comfort layer 140 has a first section 142 and a second section 144. The size and number of segments in the seams, along with the type of material used to construct the posturized comfort layer 140, may be selected so at least two of the sections may have a different firmness due to different airflows within different sections. Although two sections are illustrated in FIG. 13B, any number of sections may be incorporated into a posturized comfort layer. Although each of the sections is illustrated being a certain size, they may be other sizes. The drawings are not intended to be limiting. Although FIG. 13B shows each of the segmented seams of comfort layer 140 being circular, a posturized comfort layer, such as the one shown in FIG. 13B, may have rectangular or square segmented seams.

Figure 14:
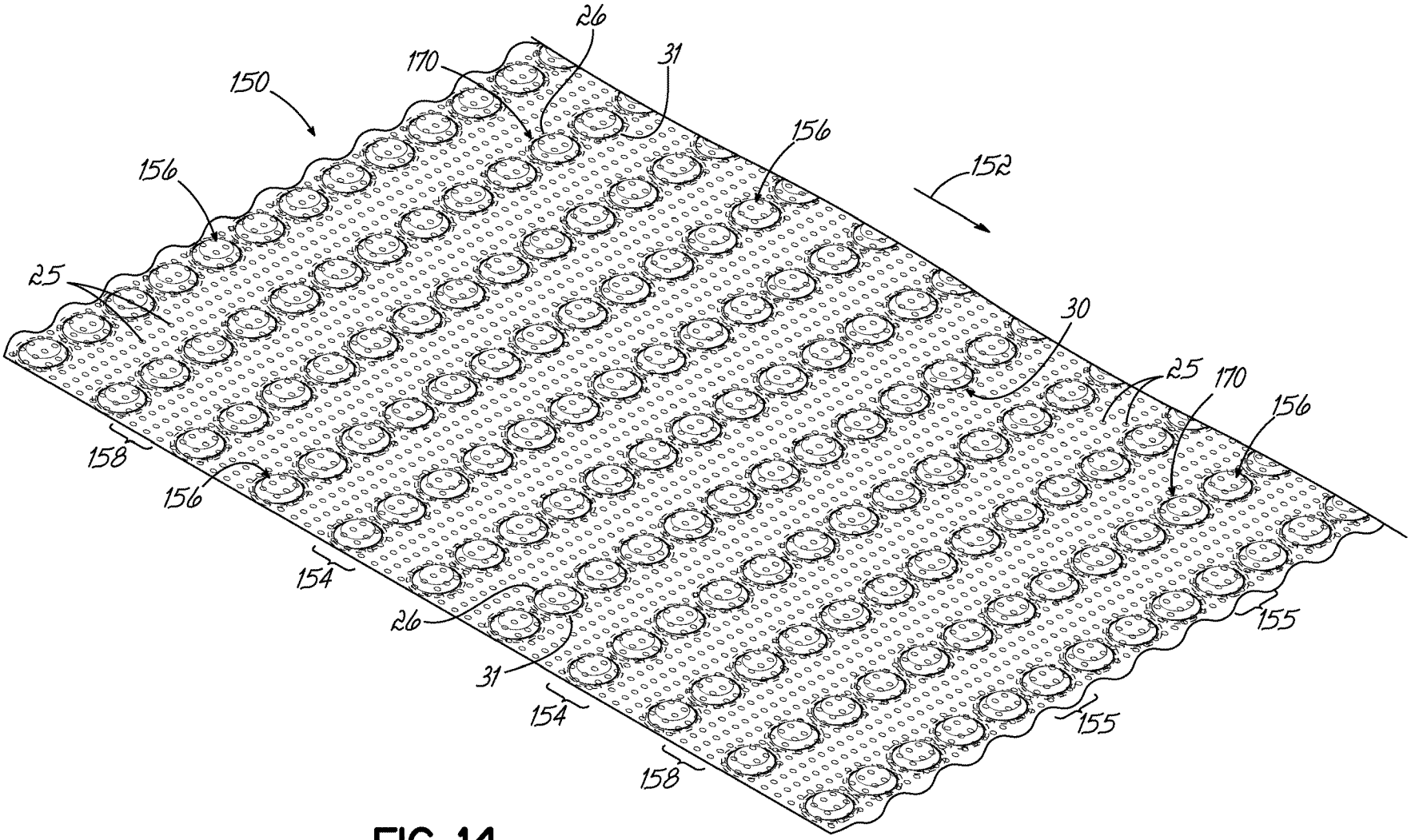
FIG. 14 is a perspective view of a web of comfort layer according to another aspect of the invention.

FIG. 14 illustrates a web or blanket 150 of comfort layer like the blanket 124 described above and shown in FIGS. 2 and 2A moving in the direction of arrow 152. The blanket 150 has a lesser density of individually pocketed mini coil springs than blanket used to make the comfort layers shown in the other drawings. In blanket 150, spaced rows 154 of pocketed mini coil springs 156 extend in a direction perpendicular to the direction of travel of the blanket 150 during manufacture. The spaced rows 154 are spaced between spaced areas 158 which contain no pocketed mini coil springs. In some applications, the spaced areas 158 may be the same size as the rows 154 so every other row of pocketed mini coil springs is missing or omitted. However, the spaced areas 158 may be any desired size. Due to the spacing between rows 154 extending from side-to-side, the pocketed mini coil springs 156 form columns 155 extending parallel the direction of travel of the blanket 150 during manufacture. Each column 155 comprises pocketed mini coil springs 156 spaced from each other a distance equal to or greater than the diameter of one circular weld seam 170. The circular weld seams 170 may be segments or solid.

Figure 14A:
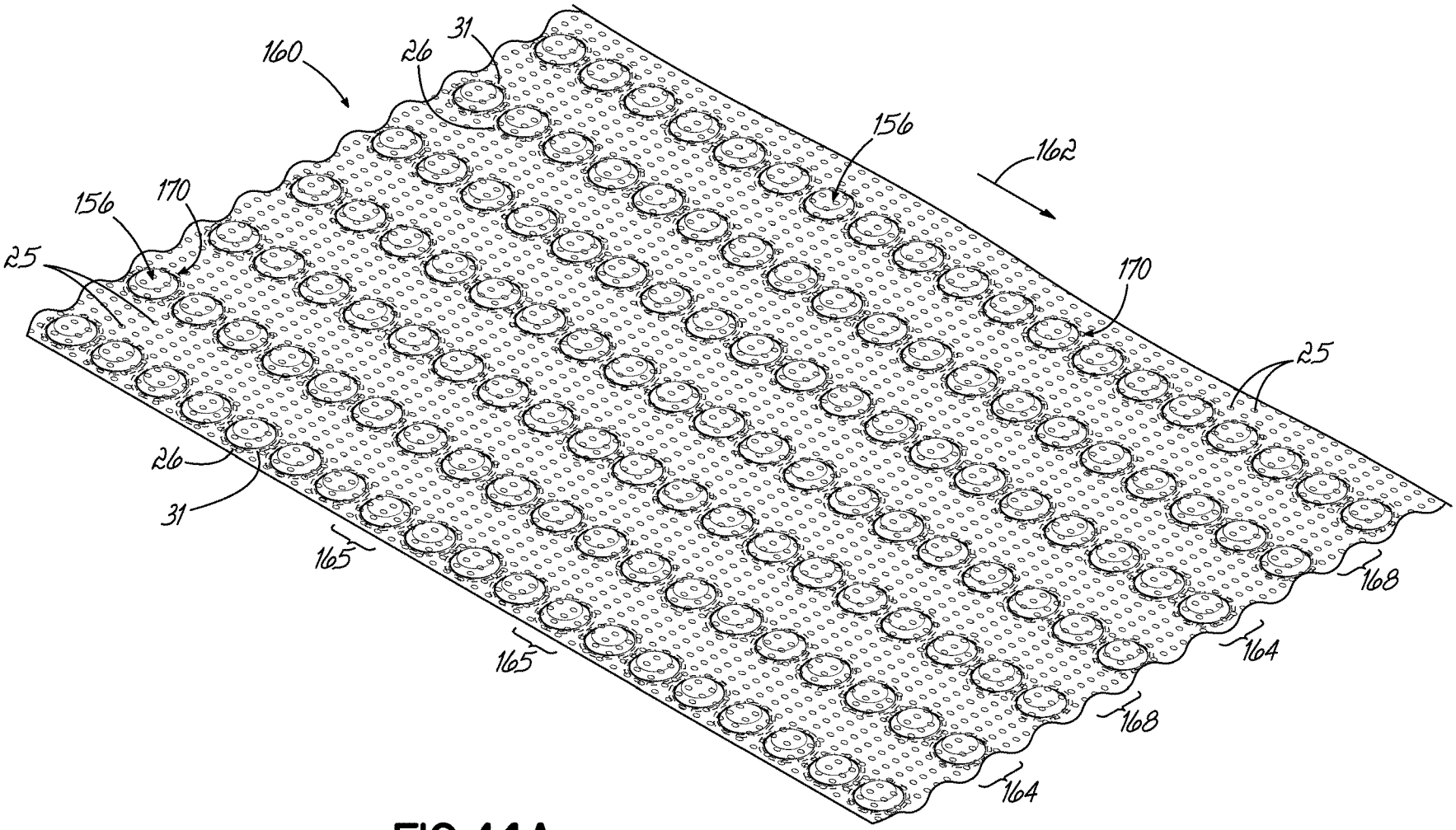
FIG. 14A is a perspective view of a web of comfort layer according to another aspect of the invention.

FIG. 14A illustrates another web or blanket 160 of comfort layer moving in the direction of arrow 162. The blanket 160 has a lesser density of individually pocketed mini coil springs than blanket used to make the comfort layers shown in the drawings other than FIG. 14. In blanket 160, spaced columns 164 of pocketed mini coil springs 156 extend in a direction parallel the direction of travel of the blanket 160 during manufacture. The spaced columns 164 are spaced between spaced areas 168 which contain no pocketed mini coil springs. In some applications, the spaced areas 168 may be the same size as the columns 164. However, the spaced areas 168 may be any desired size. Due to the spacing between columns 164 extending in the direction of travel of the blanket 160, the pocketed mini coil springs 156 form rows 165 extending perpendicular to the direction of travel of the blanket 160 during manufacture. Each row 165 comprises pocketed mini coil springs 156 spaced from each other a distance equal to or greater than the diameter of one circular weld seam 170.

Although FIGS. 14 and 14A illustrate pocketed mini coil springs 156 having circular weld seams 170, rectangular weld seams as described herein may be incorporated into the pocketed mini coil springs of FIGS. 14 and 14A. Although the drawings show the blankets 150, 160 made with nonwoven spunlaced aperture fabric, any fabric described or shown herein may be used to form blankets 150, 160.

Figure 15:
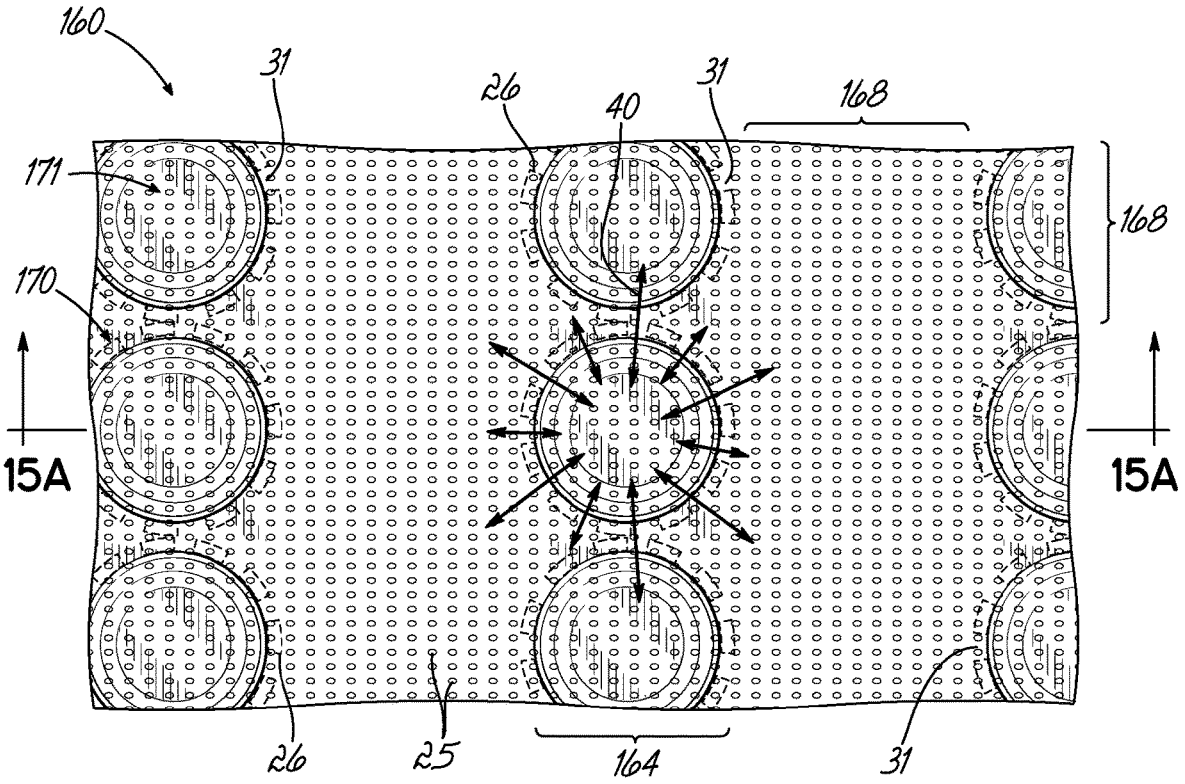
FIG. 15 is a top plan view of a portion of the comfort layer of FIG. 14, the arrows showing airflow inside the comfort layer.
Figure 15A:
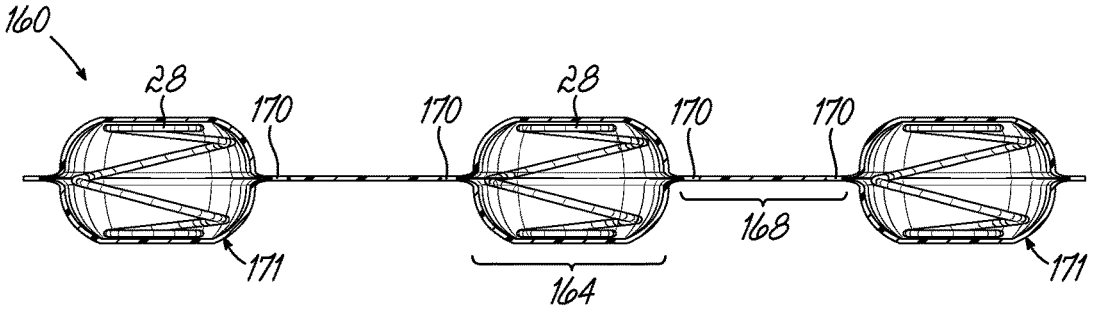
FIG. 15A is a cross-sectional view taken along the line 15A-15A of FIG. 15.

FIGS. 15 and 15A illustrate enlarged views of a portion of the blanket 160. The circular weld seams 170 are segmented having gaps 31 between curved weld segments 26, like the circular weld seams 30. FIGS. 15 and 15A show at least one mini coil spring 28 being in each pocket 171 formed by one of the circular weld seams 170. Arrows 40 illustrate airflow between the curved weld segments 26 into and out of the pockets 171.

Figure 16:
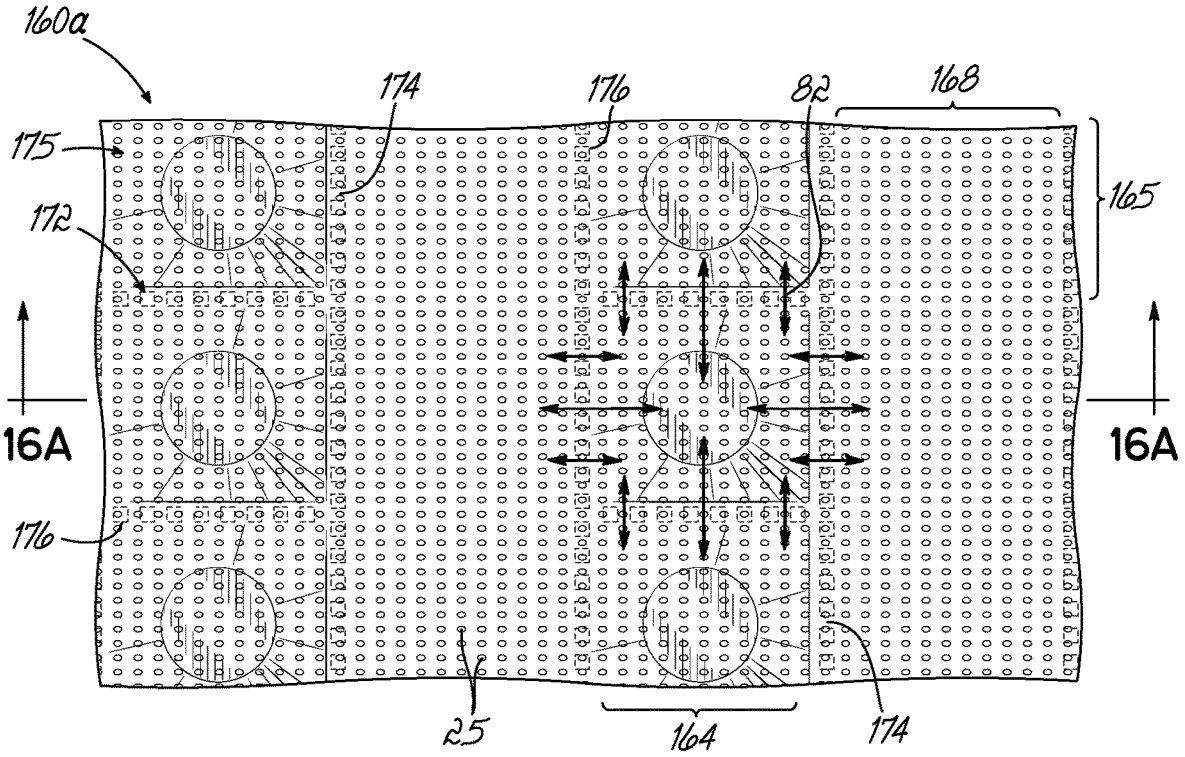
FIG. 16 is a top plan view of a portion of another comfort layer, the arrows showing airflow inside the comfort layer.
Figure 16A:
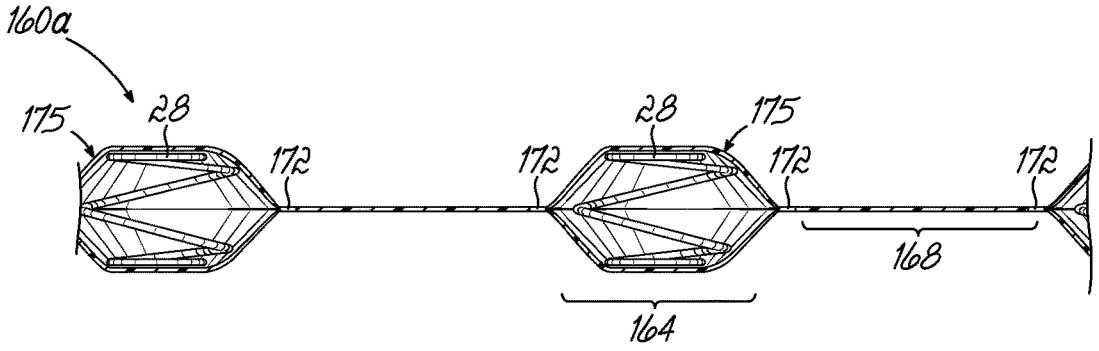
FIG. 16A is a cross-sectional view taken along the line 16A-16A of FIG. 16.

FIGS. 16 and 16A illustrate enlarged views of a portion of another blanket 160*a* having rectangular weld seams 172 rather than circular weld seams. The rectangular weld seams 172 are segmented having gaps 174 between straight weld segments 176, like the rectangular weld seams 70. FIGS. 16 and 16A show at least one mini coil spring 28 being in each pocket 175 formed by one of the rectangular weld seams 172. Arrows 82 illustrate airflow between the straight weld segments 176 into and out of the pockets 175.

Figure 17A:
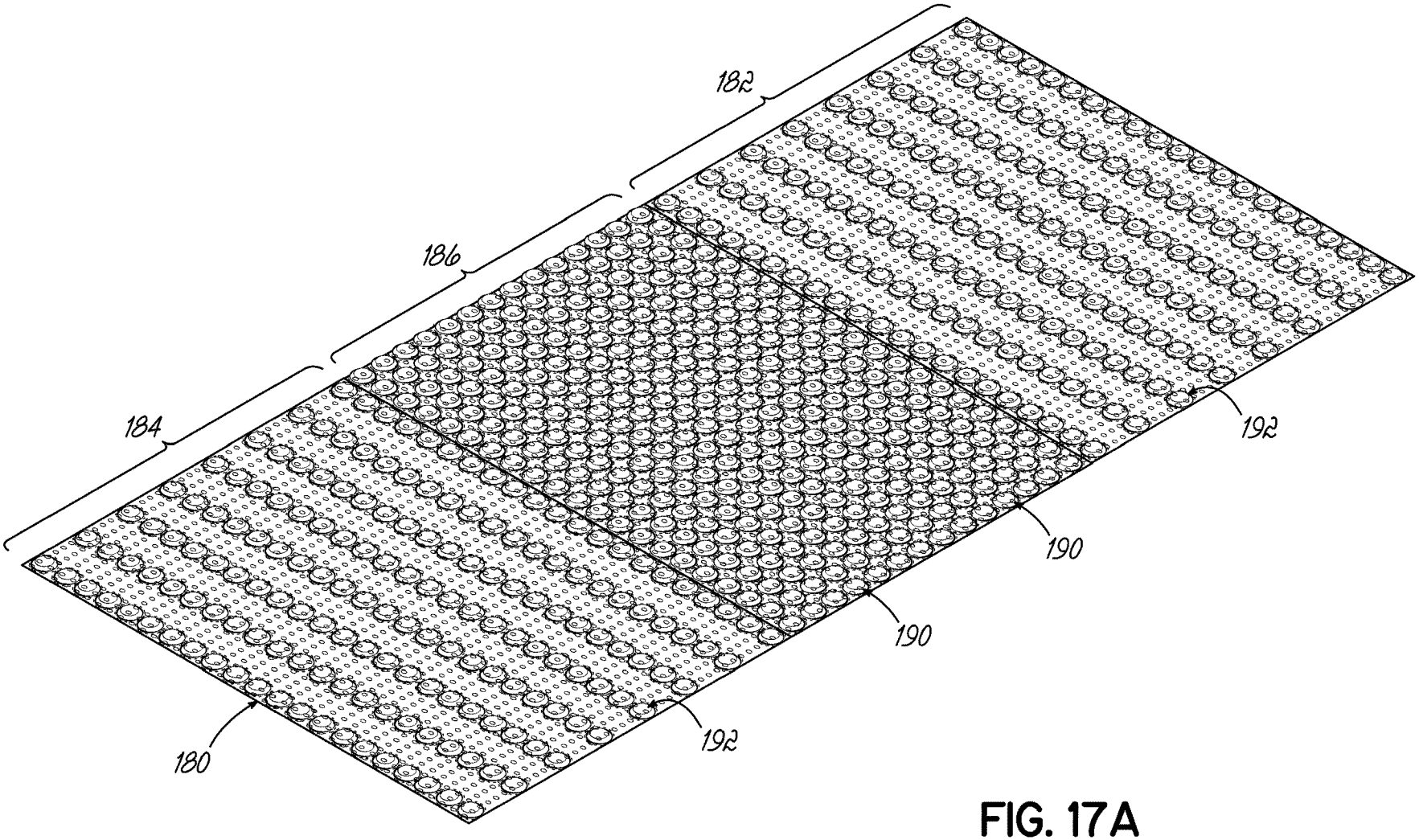
FIG. 17A is a perspective view of a posturized comfort layer.

FIG. 17A illustrates a posturized comfort layer 180 having three areas or regions of differing firmness depending upon the density of pockets within each of the areas or regions. The comfort layer 180 has a head section 182, a foot section 184 and a lumbar or middle section 186 therebetween. The number of pockets in the sections may be selected so at least two of the sections may have a different firmness. Although three sections are illustrated in FIG. 17A, any number of sections may be incorporated into a posturized comfort layer. Although each of the sections is illustrated being a certain size, they may be other sizes. The drawings are not intended to be limiting. Head and foot sections 182, 184 may have the same firmness due to having the same density of individually pocketed mini coil springs 192.

Although FIG. 17A shows each of the number of individually pocketed mini coil springs 190 in the middle section 186 being greater than the number of individually pocketed mini coil springs 192 in the head and foot sections 182, 184, the opposite may be true. Any comfort layer may be posturized by having more or less individually pocketed mini coil springs in one section when compared to another section. Although FIG. 17A shows solid circular weld seams and associated pockets, the circular weld seams may be segmented. Although not shown, a posturized comfort layer, such as the one shown in FIG. 17A, may have rectangular or square weld seams with either segmented or solid weld seams.

Figure 17B:
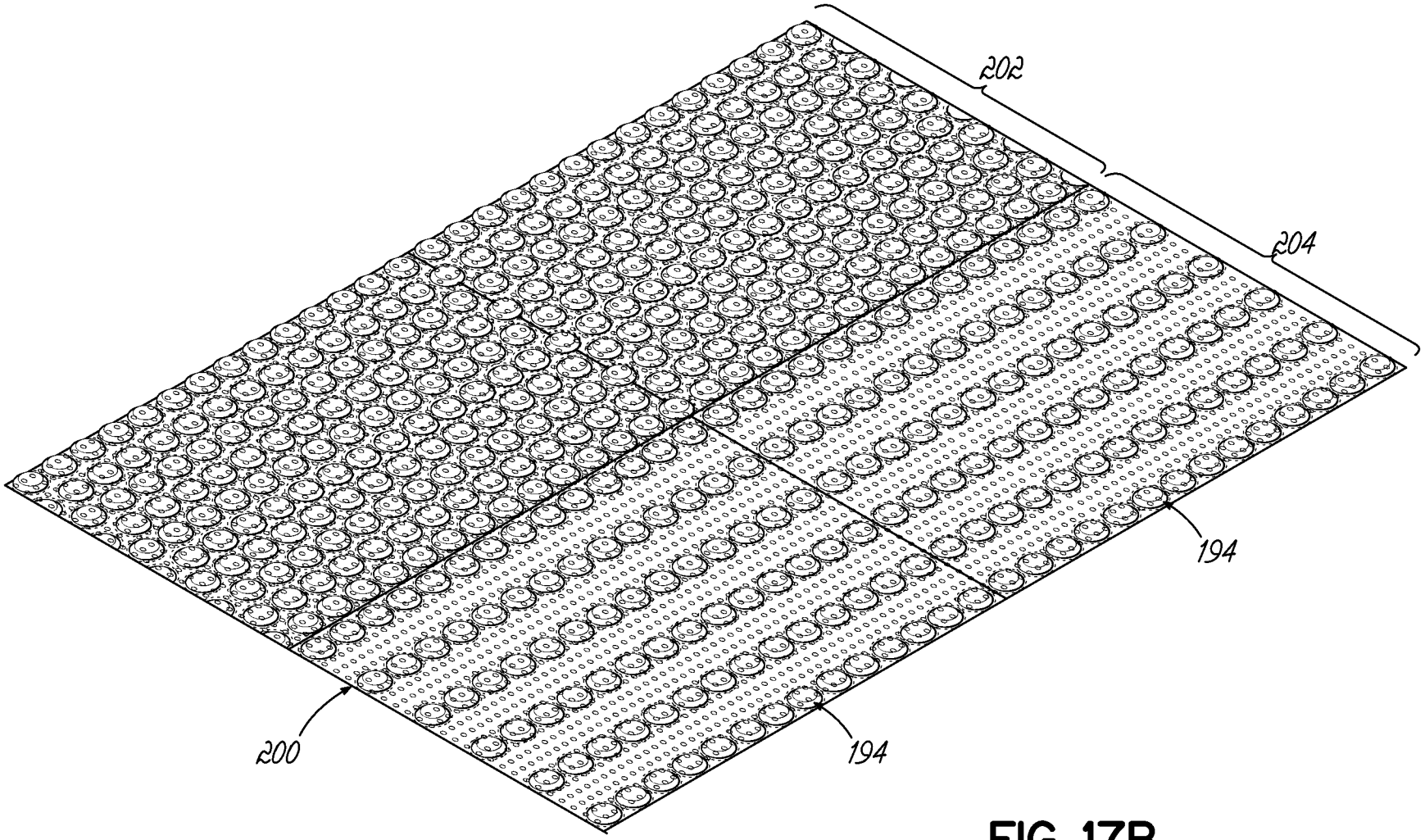
FIG. 17B is a perspective view of another posturized comfort layer.

FIG. 17B illustrates a posturized comfort layer 200 having two different areas or regions of firmness depending upon the density of individually pocketed mini coil springs 194 within each of the areas or regions. The comfort layer 200 has a first section 202 and a second section 204. The number of individually pocketed mini coil springs 194 may have different firmness due to different pocketed densities within different sections. Although two sections are illustrated in FIG. 17B, any number of sections may be incorporated into a posturized comfort layer. Although each of the sections is illustrated being a certain size, they may be other sizes. The drawings are not intended to be limiting. Although FIG. 17B shows solid circular weld seams and associated pockets, the circular weld seams may be segmented. Although not shown, a posturized comfort layer, such as the one shown in FIG. 17B, may have rectangular or square weld seams with either segmented or solid weld seams.

Although FIGS. 17A and 17B show the first and second pieces of fabric being nonwoven spun laced aperture fabric, any known fabric may be used in accordance with the posturized comfort layers having sections of different firmness due to the density of the individually pocketed mini coil springs.

While we have described several preferred embodiments of this invention, persons skilled in this art will appreciate that other permeable fabric materials may be utilized in the practice of this invention. Similarly, such persons will appreciate that each pocket may contain any number of coil springs or other type of spring, made of any desired material. Persons skilled in the art may further appreciate that the segments of the weld seams may be stitched, glued or otherwise adhered or bonded. Therefore, we do not intend to be limited except by the scope of the following appended claims.

We claim:

1. A comfort layer configured to overlay a spring core of a bedding or seating cushion product, said comfort layer comprising:

a matrix of mini pocketed springs, each mini coil spring of which is contained within a pocket, said pocket being permeable to airflow through said pocket and having a weld seam around the pocket joining first and second pieces of fabric of the pocket;

at least one of said pieces of fabric being made of a nonwoven aperture fabric to increase a rate at which air escapes through the fabric of the pocket when a load is placed on the pocket, a rate of compression of the mini coil springs subjected to the load being increased by apertures in the fabric wherein at least one of the pieces of fabric is a four mesh or greater fabric to cause air to pass therethrough at a higher or increased rate compared to a rate at which air flows through a nonwoven spunbond polypropylene material.

2. The comfort layer of claim 1 wherein at least one of the pieces of fabric is made at least partially of polyester.

3. The comfort layer of claim 1 wherein each weld seam comprises multiple weld segments.

4. The comfort layer of claim 1 wherein at least one of the pieces of fabric has a fabric weight of between 45 grams per square meter and 150 grams per square meter.

5. The comfort layer of claim 1 wherein at least one of the pieces of fabric is a ten-mesh sized fabric.

6. The comfort layer of claim 1 wherein the apertures in the fabric are oval-shaped.

7. The comfort layer of claim 1 wherein the pockets are arranged in rows spaced from each other.

8. A comfort layer configured to overlay a spring core of a bedding or seating product, said comfort layer comprising:

a matrix of mini coil springs;

a first piece of nonwoven aperture fabric permeable to airflow through the fabric on one side of the matrix of mini coil springs;

a second piece of nonwoven aperture fabric permeable to airflow through the fabric on another side of the matrix of mini coil springs, the first and second pieces of fabric being joined with weld seams to create individual pockets which contain the mini coil springs, said comfort layer being characterized, when at least some of the mini coil springs in at least some of the pockets are subjected to a load air moves through apertures in the fabric, a rate of compression of the mini coil springs being increased by the apertures in the fabric, wherein at least one of the first and second pieces of nonwoven aperture fabric is between four and twenty-two mesh fabric and air passes through the nonwoven aperture fabric at a higher or increased rate compared to a rate at which air flows through a nonwoven spunbond polypropylene material using identical test methods.

9. The comfort layer of claim 8 wherein the weld seams comprise weld segments around each of the mini coil springs.

10. The comfort layer of claim 8 wherein a rate of return of the mini coil springs in the pockets is increased by the apertures in the first and second pieces of fabric.

11. The comfort layer of claim 8 wherein the weld seams are circular.

12. The comfort layer of claim 8 wherein the weld seams are rectangular.

13. A comfort layer configured to overlay a spring core of a bedding or seating product, said comfort layer comprising:

mini coil springs;

a first piece of nonwoven fabric having apertures, the first piece of nonwoven fabric being on one side of the mini coil springs;

a second piece of nonwoven fabric having apertures, the second piece of nonwoven fabric being on another side of the mini coil springs, the first and second pieces of fabric being joined with weld seams comprising spaced weld segments surrounding each of the mini coil springs to create gaps between the weld segments and individual pockets which contain the mini coil springs, the first and second pieces of fabric being permeable to airflow through the apertures in the first and second pieces of fabric, said comfort layer being characterized, when at least some of the pockets are subjected to a load air moves quickly out of the pockets through the apertures in the first and second pieces of fabric, a rate of compression of the mini coil springs being increased by the apertures in the first and second pieces of fabric, wherein the first and second pieces of fabric have at least four apertures per square centimeter so air passes through the nonwoven fabric at a higher or increased rate compared to a rate at which air flows through a nonwoven spunbond polypropylene material.

14. The comfort layer of claim 13 wherein the fabric is made at least partially of polyester.

15. The comfort layer of claim 13 wherein the weld seams are rectangular.

16. The comfort layer of claim 13 wherein the apertures are oval-shaped.

17. The comfort layer of claim 13 wherein at least one of said first and second pieces of fabric is a ten-mesh fabric.

18. The comfort layer of claim 13 wherein said mini coil springs in a relaxed condition are approximately between 0.75 and 2.5 inches tall.

19. The comfort layer of claim 13 wherein at least some of said mini coil springs has a barrel shape.

20. The comfort layer of claim 13 wherein the pieces of fabric are the same mesh size.

* * * * *